US005799629A

United States Patent [19]

Lowi, Jr.

[11] Patent Number: 5,799,629

[45] Date of Patent: Sep. 1, 1998

[54] ADIABATIC, TWO-STROKE CYCLE ENGINE HAVING EXTERNAL PISTON ROD ALIGNMENT

[76] Inventor: Alvin Lowi, Jr., 2146 Toscanini Dr., Rancho Palos Verde, Calif. 90275

[21] Appl. No.: 632,657

[22] Filed: Apr. 15, 1996

Related U.S. Application Data

[63] Continuation-in-part of Ser. No. 311,348, Sep. 23, 1994, Pat. No. 5,507,253, which is a continuation-in-part of Ser. No. 112,887, Aug. 27, 1993, Pat. No. 5,375,567.

[51] Int. Cl.[6] ..... F02B 75/26

[52] U.S. Cl. ..... 123/56.8

[58] Field of Search ..... 123/56.2, 56.8, 123/56.9

[56] References Cited

U.S. PATENT DOCUMENTS

| | | | |
|---|---|---|---|
| 1,332,948 | 3/1920 | Murphy | 123/56.8 |
| 1,565,184 | 12/1923 | Miller | 123/56.9 |
| 1,788,140 | 1/1931 | Woolson | 123/56.9 |
| 1,808,083 | 6/1931 | Tibbetts | 123/56.9 |
| 3,456,630 | 7/1969 | Karlan | 123/56.9 |
| 3,598,094 | 8/1971 | Odawara | 123/56.7 |
| 4,432,310 | 2/1984 | Waller | 123/56.8 |
| 5,031,581 | 7/1991 | Powell | 123/56.9 |
| 5,113,809 | 5/1992 | Ellenburg | 123/56.4 |
| 5,215,045 | 6/1993 | Vadnjal | 123/56.8 |
| 5,269,193 | 12/1993 | Rabinow | 123/56.5 |

*Primary Examiner*—Marguerite McMahon
*Attorney, Agent, or Firm*—Bruce M. Canter

[57] ABSTRACT

An engine structure and mechanism that operates on various combustion processes in a two-stroke-cycle without supplemental cooling or lubrication comprises an axial assembly of cylindrical modules and twin, double-harmonic cams that operate with opposed pistons in each cylinder through fully captured rolling contact bearings. The opposed pistons are double-acting, performing a two-stroke engine power cycle on facing ends and induction and scavenge air compression on their outside ends, all within the same cylinder bore. The engine includes a novel intake/exhaust valve configuration, a novel combustion chamber configuration and a novel external piston rod alignment structure comprising a cam follower assembly including a pair of needle roller bearings riding in longitudinal grooves machined in the cam follower body.

9 Claims, 23 Drawing Sheets

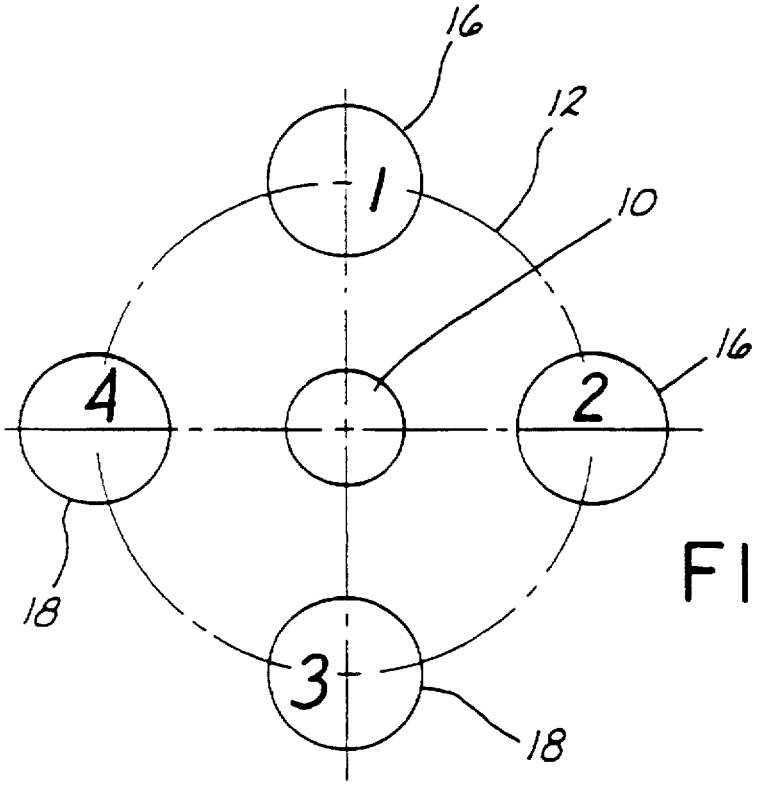
FIG. 2
FIG. 3
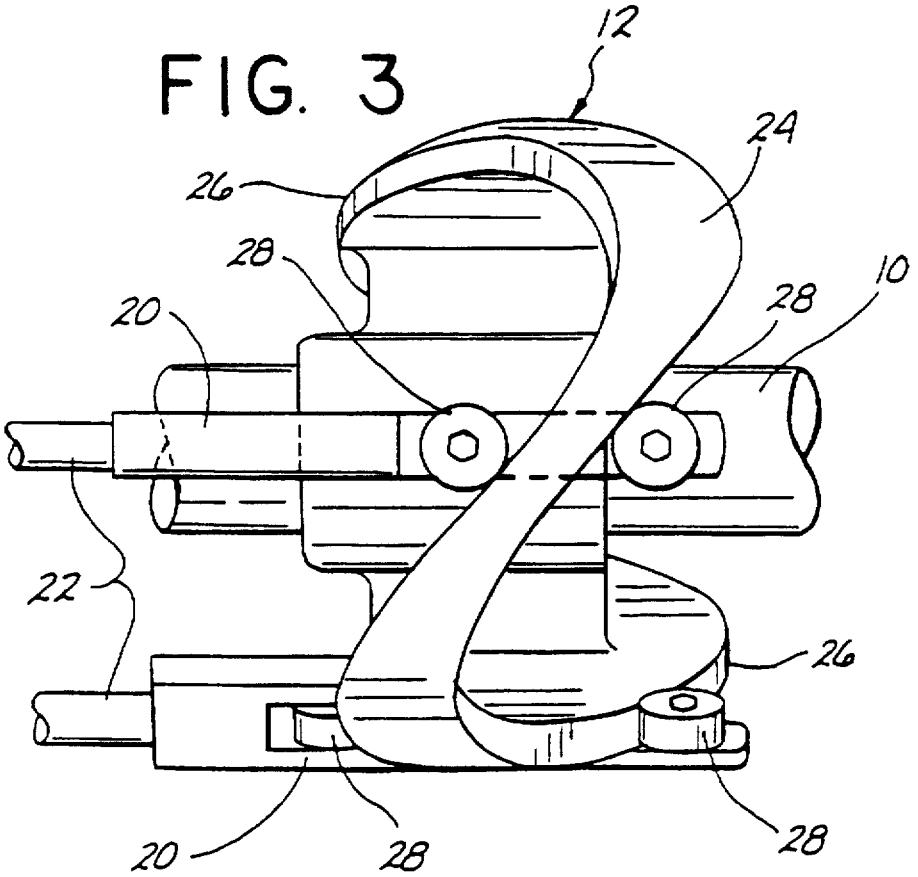

FIG. 6
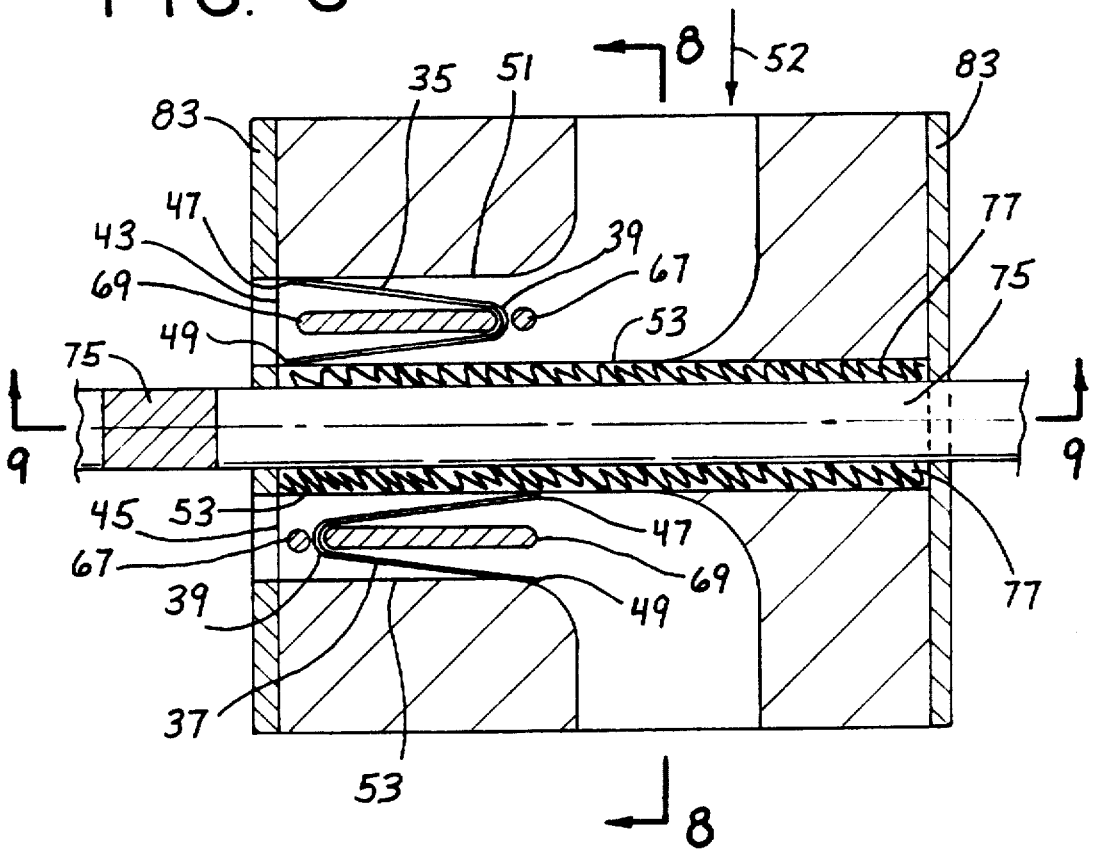
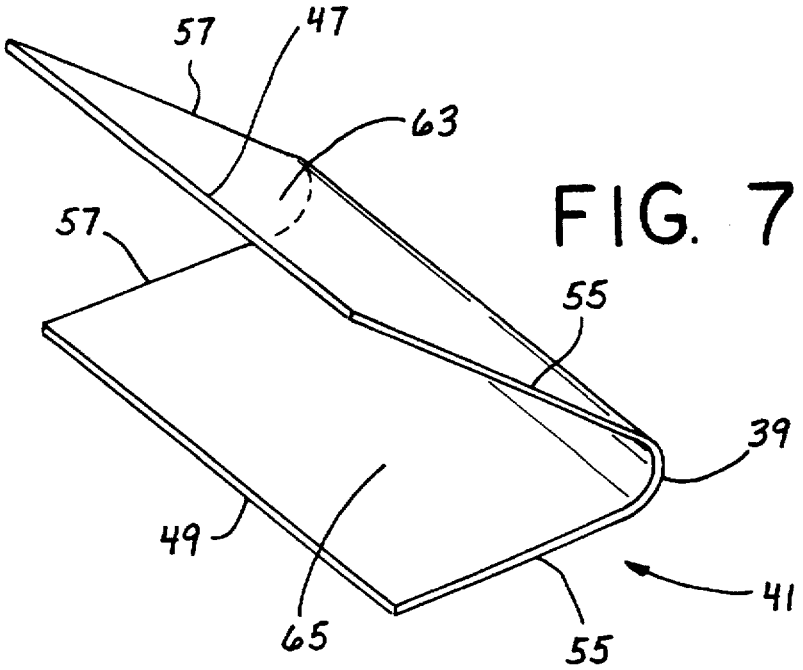
FIG. 7

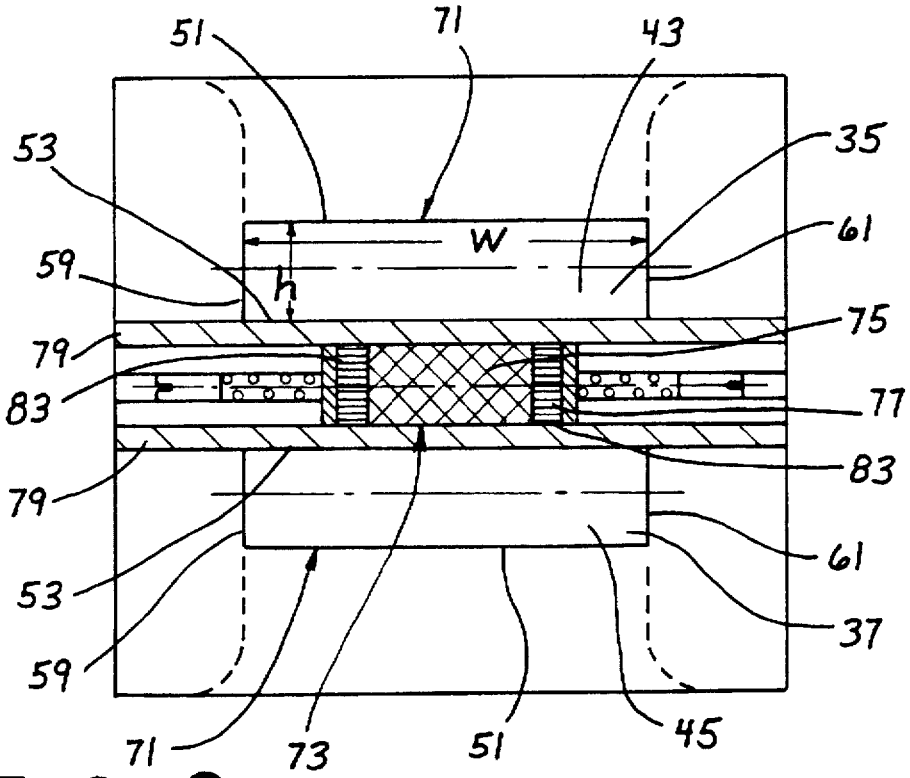
FIG. 8
FIG. 9
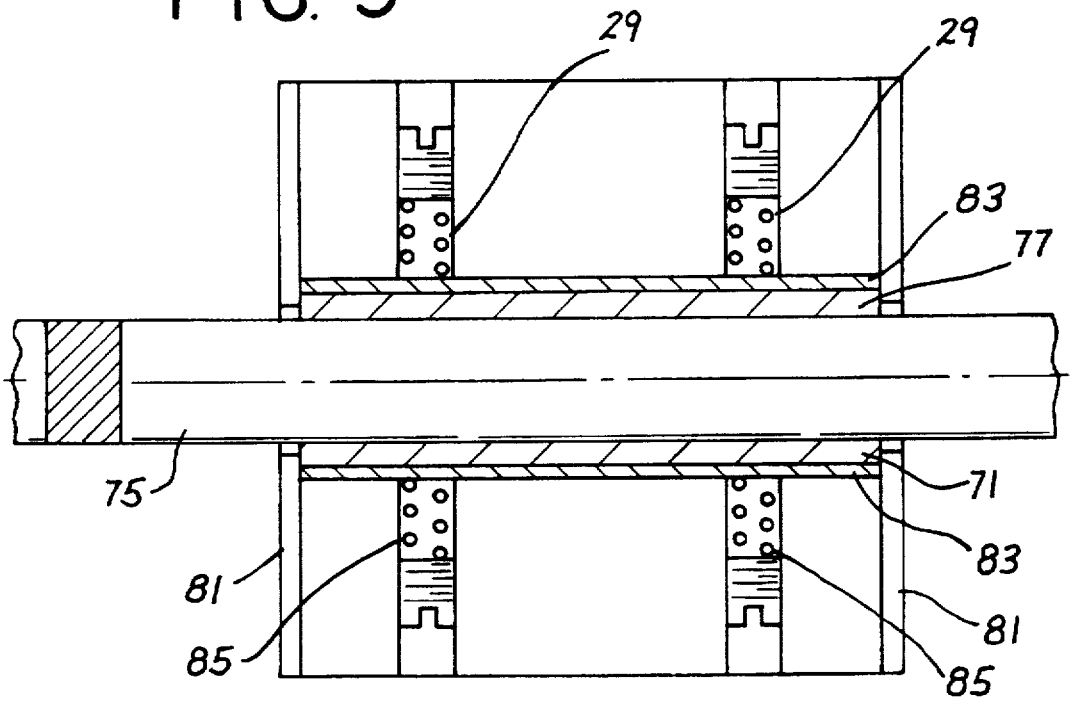

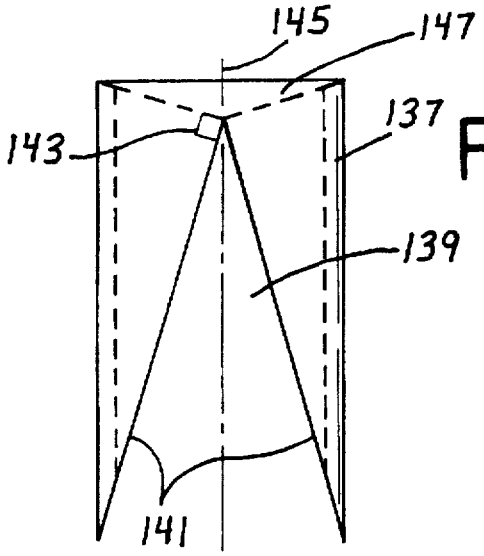
FIG. 14A
FIG. 14B
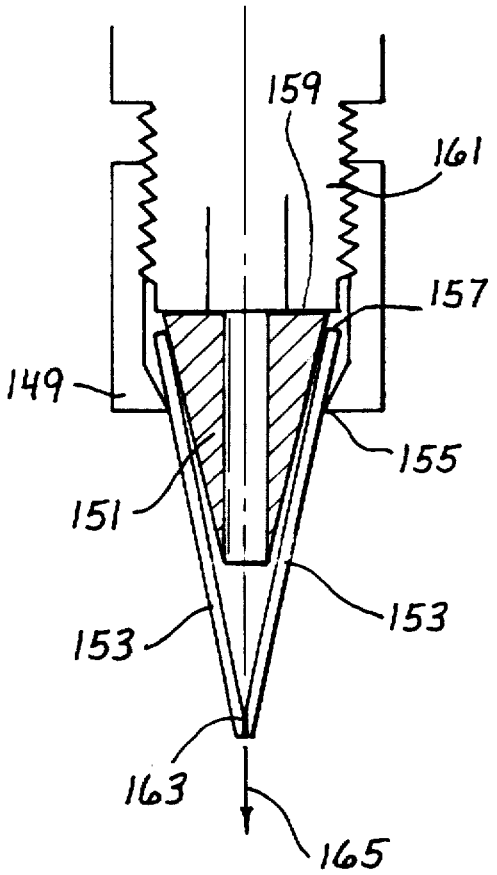
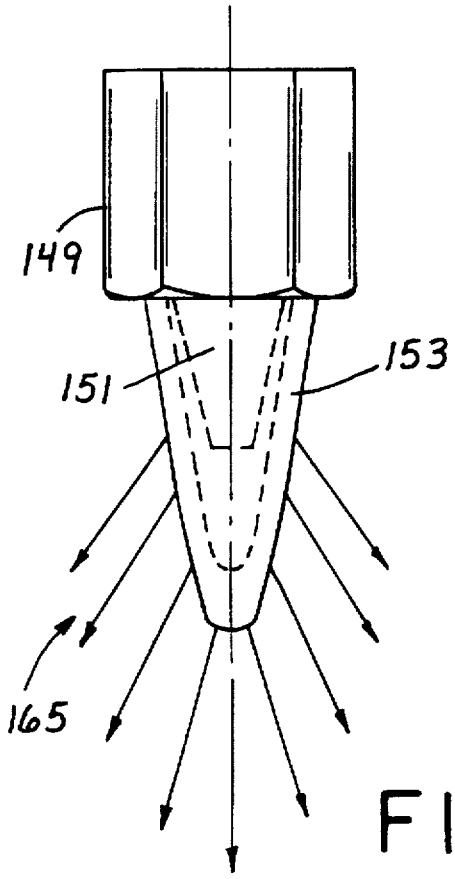
FIG. 14C

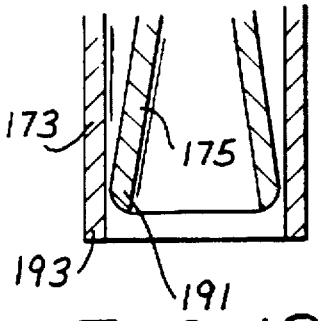
FIG. 18A
FIG. 18C
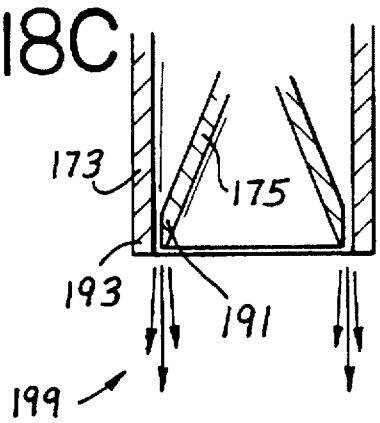
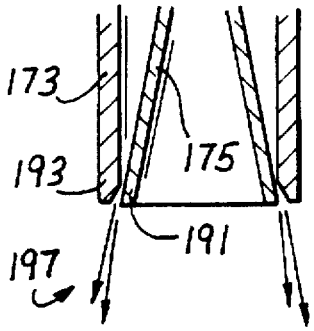
FIG. 18B
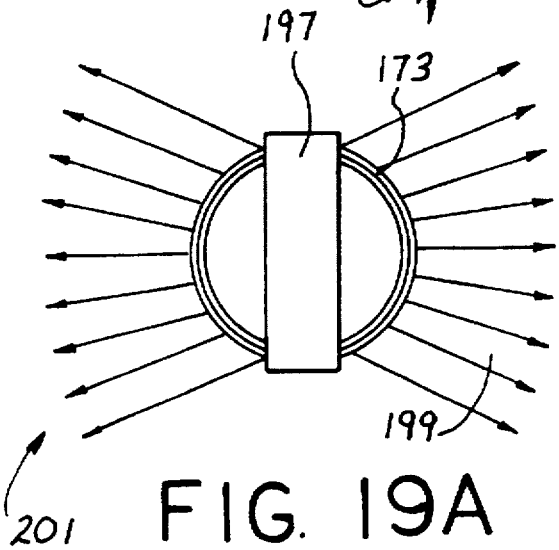
FIG. 19A
FIG. 19B
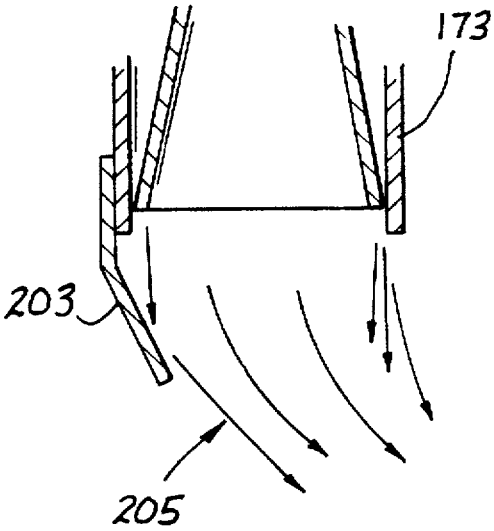
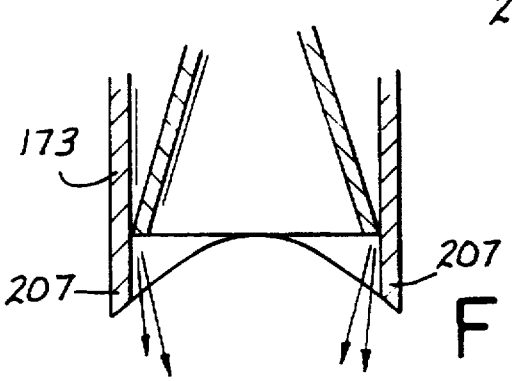
FIG. 19C

ADIABATIC, TWO-STROKE CYCLE ENGINE HAVING EXTERNAL PISTON ROD ALIGNMENT

RELATED CASES

This application is a continuation-in-part of U.S. application Ser. No. 08/311,348, filed on Sep. 23, 1994, now U.S. Pat. No. 5,507,253, which was a continuation-in-part of U.S. application Ser. No. 08/112,887, filed Aug. 27, 1993, issued as U.S. Pat. No. 5,375,567, both of which are incorporated by reference as if fully set forth herein.

GOVERNMENT RIGHTS

This invention was made with Government support under NAS2-13998 awarded by the National Aeronautics and Space Administration. The Government has certain rights in the invention.

FIELD OF INVENTION

This invention relates to uncooled, two-stroke-cycle, opposed-piston, uniflow-scavenging internal combustion engines, and to certain structural improvements thereto. Specifically, the engine relates to an axial-cylinder, twin-barrel-cam engine, having a novel intake/exhaust valve configuration, a novel combustion chamber configuration and a novel external piston rod alignment structure. The engine system herein has particular value in aviation propulsion and other engine power applications demanding maximum performance over wide load, speed and altitude range.

BACKGROUND—DESCRIPTION OF PRIOR ART

Heretofore, internal combustion engines of the reciprocating type have been constructed of metals in forms best suited for their fabrication in such materials. However, due to these materials prior art engines require supplemental cooling and lubrication in order to function properly with adequate durability. These cooling and lubrication requirements further require provisions for fluid circulation and heat rejection accessories that can be burdensome in many applications. Aircraft applications of such engines are particularly sensitive to the installation of such accessories because of the weight and aerodynamic drag associated with their proper usage. In addition, the control of fluids in aircraft engines and their remote accessories such as radiators, oil coolers, pumps, oil sumps and the like is complicated because a fixed gravitational orientation can not be relied upon to disengage vapors and liquids and establish fluid levels.

A further disadvantage of most prior art engine constructions for aircraft applications is their dependence on increased output shaft speed as a means of reducing weight per unit of power output. Because propellers function efficiently only with limited rotational speeds, most lightweight engines of the prior art type require speed-reducing gear boxes, and perhaps even variable ratio transmissions, to properly match their outputs to suitable propellers. Such mechanical accessories have cooling and lubrication requirements of their own and can add significant weight, cost and complexity to the installation, particularly for small-engine and high-altitude applications. Such speed constraints are not limited to aircraft applications. Certain alternators and compressors represent other important drive applications that are so limited.

Most prior art engines employ structural arrangements, assemblies and mechanisms that are highly dependent on the tensile properties of the customary metallic materials which have limited temperature tolerance, expand significantly when heated and are prone to galling under sliding and rubbing contact. They require sophisticated cooling and lubrication schemes to maintain their mechanical and structural integrity and their weight and balance is highly sensitive to increases in cylinder working pressures and rotational speeds. Thus, prior art engines that operate on the diesel cycle are somewhat heavier and larger than their spark ignition counterparts and they also present greater lubrication, cooling and balancing burdens. This accounts, to a large extent, for the lack of acceptance, heretofore, of prior art type diesel engines for aircraft applications notwithstanding their potentially superior flight-worthiness, safety, fuel economy and fuel flexibility characteristics.

Various attempts have heretofore been made to overcome some of these problems by designing diesel engines with large heat retention capacities. Examples of such "adiabatic engine" are those manufactured by Adiabatic Inc. and Cummins. These adiabatic engines utilize insulated parts, heat tolerant components and high-temperature tribology or friction controls. However, such friction controls require advanced chemistry for liquid lubrication. What is needed is an adiabatic engine that overcomes these shortcomings.

With rare exceptions, prior art reciprocating engines, adiabatic or otherwise, utilize crankshafts and connecting rods for the translation of reciprocating to rotary motion. This arrangement has been successfully applied to engines comprised of from one to many cylinders laid out in various configurations such as in a single line of cylinders parallel to the crankshaft, banks of inline cylinders disposed around the crankshaft, radial cylinder dispositions and opposed-piston arrangements using one or more crankshafts geared together. A few crankshaft-type engines are known which have been constructed with parallel cylinders axially aligned in a barrel arrangement around the crankshaft or with inline cylinders transverse to the crankshaft. Both of these types rely on additional auxiliary mechanisms such as gear trains, rocker arms, wobble plates, universal ball joints and the like for the translation of power.

Prior art engines that utilize crankshafts provide no mechanical advantage in the conversion of piston motion to shaft torque. Furthermore, eccentricities in connecting rods and the like produce side loads in the reciprocating pistons which give rise to friction and vibration. Another disadvantage of crankshaft-type engines is the complex load path that must be structurally accommodated in maintaining the mechanical integrity of the engine. Typically, such loads are passed through the cylinder walls which must also handle the stresses due to combustion. As a result, the cylinders must be constructed of materials having high tensile strengths. Due to the complex forms of the structures required, metallic materials constitute the only economic and durable means of construction, and then only if an abundance of cooling and lubrication is used. Furthermore, crankshafts, by nature, must span the length of the engine. Because of this, as well as a poor structural geometry for the loads imposed, crankshaft engines require somewhat more weight, strength and stiffness in the shaft, bearings and supporting structure to obtain an adequate degree of torsional rigidity and structural integrity.

The axial piston or barrel configuration typified by the prior art engines of Herrmann, Sterling/Michel and others offers improved compactness, structural efficiency and frontal area. These characteristics are desirable for an engine.

However, none of these characteristics has been obtained in the prior art with the use of thermally tolerant and self-lubricated materials in the principal parts. All of these prior art engines rely on the established principles of ironmongery, which succeeds only with proper cooling and lubrication. None of the prior art engines suggests the use of non-metallic construction or arrangements, hence, the burdens of supplemental cooling and lubrication remains.

Many of these prior art engines, such as Junkers, Hill and Sterling/Michel, have utilized opposed-piston arrangements which avoid the use of cylinder heads and the stresses, dynamic forces, seals, attachments and fastenings attendant thereto. Although this arrangement is limited to two-stroke-cycle operation, this can be advantageous for some applications, provided aspiration and cylinder scavenging can be properly attended. Other advantages of the opposed-piston arrangement include reduced combustion chamber heat losses, improved compactness for a given cylinder displacement and reduced piston speed for a given power output.

For example, the Sterling/Michel engine includes an opposed piston arrangement that utilizes a double swash-plate for translating axial to reciprocating motion (see, Heldt, P. M., *High Speed Diesel Engines*, 4th Ed., Nyack, N.Y., 1943, pp. 308–309). However, the Sterling/Michel engine has swashplate followers which impart significant side loads. Furthermore, the engine requires a separate scavenging system and supplemental lubrication. Finally, the Sterling/Michel swashplates are single harmonic, thereby yielding only one power stroke per revolution.

The Junkers engine utilizes two crankshafts in an inline cylinder, opposed piston configuration, thus also yielding only one power stroke per revolution (see Heldt, pp. 320–326). Furthermore, the articulated piston/crankshaft arrangement imparts significant side loads as well. The Junkers engine also utilizes a separate scavenging system, requiring appurtenances which add to the complexity and weight of the engine structure.

The Hill engine has opposed pistons with a single crankshaft/rocker arm assembly that is transverse to the center of the cylinder (see Heldt, p. 310). Thus, it too has side load problems.

Sterling/Michel, Junkers and Hill all used opposed pistons, but none foresaw the opportunity for constructing their engines in a manner that could utilize in any significant respect thermally tolerant and self-lubricated materials. Further, all utilize reciprocating-to-rotary conversion mechanisms that impart side loads on their pistons and which cannot provide any mechanical advantage in the production of torque other than by the familiar method of increasing the piston stroke and/or combustion pressure. Finally, none of these prior art engines included integral aspiration and scavenging means, thus necessitating external or add-on appurtenances such as additional scavenge pump cylinders or separate mechanically-driven blowers.

There is a recently disclosed (date unknown), two-stroke-cycle, opposed piston engine which has significantly reduced or eliminated side loads on the pistons (see the DARPA/Land System Office engine in the Advanced Research Projects Agency Brochure, page 38). This engine utilizes four crankshafts, two counter-rotating crankshafts on each cylinder end. Due to the counter-rotating crankshafts, each having opposing connecting rods attached to a piston, the net side load on each piston is approximately zero. However, this engine structure is mechanically very complicated and does not lend itself to the use of thermally tolerant materials.

Another prior art engine, that of Herrmann (U.S. Pat. Nos. 2,243,817, 818, 819, and 820, all issued in 1941) teaches the use of a double harmonic barrel cam engine. The Herrmann engine utilizes a single cam arrangement in a four-stroke cycle axial cylinder configuration having improved torque multiplication, reduced piston side loads and lower torsional vibrations in the output shaft. However, Herrmann did not anticipate or suggest the use of double-harmonic cams in an opposed piston engine having an axial cylinder arrangement. Furthermore, Herrmann's engine operates on a four-stroke-cycle. Thus, even though Herrmann's double harmonic cam increases the number of piston strokes per shaft revolution, it only obtains one power stroke per revolution. Any further increase in torque output would require the use of a two-stroke-cycle engine. Such an attempt to utilize the Herrmann single cam teachings in a two-stroke-cycle engine would be encumbered by the need for highly stressed cylinder heads and difficult valving and porting locations which necessitate the use of cooled and lubricated metallic construction.

Various prior art engines have disclosed the advantages of a variable compression ratio in a reciprocating engine and several means for accomplishing this during engine operation are well known. Wallace and Lux (SAE Transactions No. 72 p. 680, 1964), for example, disclose a means of controlling the clearance volume of the cylinder by hydraulically positioning the piston crown above the piston pin. This technique is burdened with the complexity of supplying hydraulic fluid in a controllable manner through rotating and reciprocating members into the most intensely heated and highly stressed region of the engine, namely the piston crown. Another method known in the art is one disclosed by Paul and Humpreys (SAE Transactions No. 6, p. 259, April, 1952) in which the cylinder head of the engine is spring-loaded to allow the clearance volume to change with increased cylinder pressure. This method is mechanically and structurally complex and it also requires intense cooling of the springs in order to prevent premature failure of the mechanism. Still another method of varying the compression in operation applies only to a rocking-beam type opposed piston engine as disclosed by Clark and Skinner (SAE Paper 650516, 1965), wherein a variable compression system was integrated into the Hill engine. This method changes the piston stroke and, thus the total cylinder displacement, by simultaneously altering the rocker ratio between a single transverse crankshaft and the twin connecting rods of the opposed pistons. This technique utilizes a pair of eccentric rocker shafts that are synchronously rotatable within heavily loaded bearings which requires a precise and robust mechanism having critical lubrication problems. In fact, all of the prior art mechanisms described above are vulnerable to intense heat and load exposure.

Reconnaissance of the prior art of opposed piston engines has failed to produce an example of means for simultaneously and independently altering both piston clearance and piston phasing during engine operation. U.S. Pat. Nos. 4,956,463 and 5,058,536 to Johnston show how to vary the piston phasing in a Junkers type twin crankshaft engine by altering the phasing of the gear train connecting the two crankshafts. Timoney (SAE Paper No. 650007) shows how to alter the compression ratio of a Hill-type single-crankshaft/rocker-arm engine by using eccentric rocker shaft mountings to vary the piston clearances. Neither of these prior art opposed piston engines teaches a method for accomplishing running adjustments of both compression ratio and port timing independently and neither applies to the axial piston engine of my invention which is disclosed in the parent application.

Johnston shows the advantages of attaining extremely high compression ratios for high altitude operation but his method can accomplish this only by maximizing port overlap. As a result, scavenging efficiency and supercharging will be sacrificed under conditions when those aspects of engine performance are at a premium.

Timoney shows a method for varying the running clearance of the pistons, varying the compression ratio with a negligible change in piston phasing and stroke. Thus, Timoney's method could not be used to optimize port overlap as well as compression ratio.

The history of the internal combustion engine contains an abundance of examples of engines constructed with unusual means for the translation of power (see, for example, Setright, L. J. K., *Some Unusual Engines*, Mechanical Engineering Publications, Ltd., London, 1975). Whatever the various advantages offered by many of these prior art examples, none overcomes the structural, thermal, mechanical, dynamic and frictional limitations that have been a barrier, heretofore, to the construction of an engine that can operate free of vibration, supplemental cooling and lubrication.

SUMMARY OF THE INVENTION

What is provided by the engine of my invention is a two-stroke-cycle, adiabatic engine that is structurally compact and can operate free of vibration. The engine is capable of utilizing thermally tolerant materials, thereby obviating the need for supplemental cooling and lubrication. The engine comprises an axial assembly of cylindrical modules and twin, double-harmonic cams that operate with opposed pistons in each cylinder through fully captured rolling contact bearings. The engine may comprise one or more pairs of axially symmetric cylinder modules which with their opposed pistons perform perfectly balanced reciprocating and rotary motions at all loads and speeds. The opposed pistons are double-acting, performing a two-stroke engine power cycle on facing ends and induction and scavenge air compression on their outside ends, all within the same cylinder bore.

The engine of my invention also provides novel intake/exhaust valve configurations, a novel piston head structure providing a novel combustion chamber, and a novel external piston rod alignment structure.

The benefits of the structure of my engine are the elimination of side loads on the pistons, tensile stresses in the cylinders and unbalanced forces in its structure, while accomplishing a variable compression ratio, self-aspirated, self-scavenged two-stroke-cycle engine having improved thermal tolerance, smoothness, compactness and weight characteristics. As will be shown in the following, the engine of my invention, having no cylinder heads, crankshafts or connecting rods, can utilize lightweight, self-lubricated, thermally-tolerant materials such as graphite and silicon nitride ceramics in a structurally, thermally and mechanically efficient manner whereby to accomplish an engine of improved characteristics for high-altitude, subsonic aircraft propulsion and other engine power applications.

Furthermore, piston clearance and phasing in the engine of my invention can be varied in the following ways:

1. Axial displacement of the moveable cam rings relative to fixed-location cam wheels (equal and opposite at each end of axial shaft) can produce a change in piston clearance with a negligible change in phasing. If no angular displacement is desired with such axial displacement, a straight key in an axial key slot is used. This effects a change in compression ratio without a change in piston phasing (see FIG. 24A).

2. Coordinated angular and axial displacement of the moveable cam rings can be obtained by cutting the key slot at a helical angle so that axial movement of the key guided in the slot causes rotation of the cam ring on the cam wheel. The helical pitch and direction of the slot determines the relationship between piston clearance (compression ratio) and piston phase (port timing) variation.

3. Independent angular and axial displacement of the cam rings can be managed by using a moveable cylindrical roller key in a straight axial guide slot. An eccentric roller key shaft is rotated to produce angular displacement of the ring with respect to cam wheel.

Reduced overlap with increased compression ratio is beneficial at partial load and high speeds and/or at high altitudes where performance penalties due to excess scavenging are greater. High overlap with high compression ratios is desirable for starting, idling and low speed operation. The reasons for this are related to scavenging with a limited air supply when more port overlap is needed to purge residual combustion products from the cylinder and replace with fresh combustion air. This process takes time depending on the charge air pressure available and the mean flow resistance through the cylinder via the ports. Low speeds provide more time but this is more than offset by somewhat lower charge pressures than can be provided. Under such conditions, increased port overlap decreases the mean flow resistance allowing more flow at reduced pressure. Such flow enhancement costs little additional power because of the lower scavenge pressures developed at low speed so that an excess of flow over what is needed for scavenging does not penalize engine performance. Furthermore, low speeds usually occur with partial load which, for a diesel, calls for considerable excess air (oxygen) over chemical correctness. At these conditions, low fuel injection quantities are required which usually attain a lower injection quality. For this reason, high compression ratios are desirable to obtain good ignition quality.

With increased speed, ports are open for a shorter time interval but more charge air pressure is available. Under these conditions, excessive port overlap can produce over-scavenging which results in excessive parasitic power and reduced part-load engine performance. Reduced port overlap (more exhaust port lead) is beneficial for allowing a greater degree of exhaust to occur by natural blow-down thereby reducing the charge pressure and flow requirement for an adequate degree of scavenging. Another benefit of reduced overlap here is that supercharging of the cylinder can develop to a greater extent with delayed intake port closure so that a greater air charge can be trapped in the cylinder. This increased charge density along with increased turbulence and charge motion improves ignition and combustion as well as power potential. Maintaining high compression ratios at these conditions then obtains high cycle thermal efficiencies without excessive combustion pressure spikes.

Increasing the load (greater injected fuel quantity) on top of a high supercharge at a high compression ratio raises cylinder peak pressures considerably. Higher cycle performance is accompanied by higher mechanical loadings which produce greater friction losses tending to offset thermodynamic performance gains. Further, the higher compression pressures, charge densities and fuel quantities crowds the combustion space, increases heat losses, and impairs injection and combustion performance. A reduced compression ratio (increased chamber volume) provides some relief from these effects with only small losses in cycle thermal efficiency. Structural and cooling loads are also relieved somewhat thereby. The advantages of independent control of compression ratio and piston phasing are evident from a review of Table 1 which lists the most favorable combinations of compression ratios and port overlaps for various operating conditions.

TABLE 1

| Operating Conditions | Compression Ratio | Port Overlap |
|---|---|---|
| Starting | High | High |
| Idling | High | High |
| Low Speed, High Load | Low | High |
| High Speed, Low Load | High | Low |
| High Speed, High Load | Low | Low |

The advantages of my engine invention over the prior art mentioned above include minimal heat rejection, minimum weight, maximum balance, maximum smoothness, structural simplicity, maximum torque for minimum displacement, self-scavenging, and compactness. It also provides a simple and effective means of varying the compression ratio during operation without having to contend with critical structural, cooling and lubrication problems.

OBJECTS AND ADVANTAGES

Accordingly, the several objects and advantages that my reciprocating, internal combustion heat engine invention accomplishes are:

1. Operation in a two-stroke-cycle without external or add-on aspiration and scavenging accessories or cylinder heads;

2. Attainment of improved thermal efficiency through reduced heat losses and friction by permitting the utilization of thermally-tolerant, self-lubricated materials, preventing piston side loads and using an all-rolling-contact mechanism for converting reciprocating motion to shaft rotation;

3. Achievement of improved torque output with reduced shaft speed and piston displacement by using twin double-harmonic cams, opposed pistons and a two-stroke-cycle;

4. Attainment of improved smoothness by balancing all reciprocating masses, pressure forces and dynamic moments and by the substantial reduction of torsional variations in the output shaft;

5. Facilitation of the utilization of lightweight, thermally-tolerant materials such as graphite and ceramics in a structurally efficient arrangement that does not require supplemental cooling or lubrication and achieves great torsional rigidity and structural integrity;

6. Attainment of high power density and specific power output using diesel cycle operation for the attainment of maximum fuel economy, flexibility, safety and reliability;

7. Attainment of high compression ratios for ease of starting and operating at light loads with high fuel economy;

8. Attainment of variable compression ratios in operation to facilitate high power outputs with limited combustion pressures;

The major advantage of the control system of my invention is the optimization of engine performance at any combination of load, speed and altitude. The advantages of clearance volume adjustment with load are well known. As elaborated by Timoney, for example (SAE Paper No. 650007), high compression ratio at light shaft loads maximizes engine thermal performance at low BMEPs. A high compression ratio also improves cold start characteristics by raising compression temperatures to improve ignition.

Reducing the compression ratio at high shaft loads reduces peak cylinder pressures for a given BMEP and improves combustion efficiency by providing a more favorable combustion chamber volume. It also raises exhaust gas temperature and pressure for improved turbocharging. This is most important for maximizing power output at high altitude and for maximizing torque-rise upon lug down in traction applications. A reduced compression during cranking is advantageous for minimizing cranking power and accelerating engine starting without the use of an external compression relief feature.

The advantages of variable piston phasing affecting the timing of intake and exhaust port opening and closing in an opposed piston uniflow 2-cycle diesel have been suggested by R. Johnston (AIAA Paper No. 89-1623-CP) but are readily perceived by study of Schweitzer (ref. textbook, MacMillan, 1949). As stated therein, Maximum port overlap (period when both intake and exhaust pats are open) minimizes intake supercharge which is best for light load conditions because it results in a minimum of parasitic power (scavenge power) with adequate scavenge efficiency and without excessive scavenge flow. At maximum power, particularly at high altitudes, more exhaust lead (exhaust ports open before intake ports) allows more exhaust blowdown without expenditure of scavenge air and provides more exhaust energy for turbocharging. The obverse, less port overlap and more intake lag, provides increased supercharging from a given amount of intake manifold pressure without over-scavenging and wasting of scavenge power.

In all known opposed piston engine layouts, an increase in the piston phase angle results in increased clearance volume for a given geometrical piston clearance. Thus, a certain decrease in the compression ratio occurs with an increase in the piston phasing. This relationship is favorable for some but not all engine operating conditions. It is useful for optimizing engine performance with increasing load at sea-level. The opposite is true at high altitudes.

Piston clearance adjustment independent of phase angle adjustment can be used to optimize engine performance at all operating conditions. For example, at altitude, greater compression ratios are advantageous as well as reduced overlap. Therefore, an independent adjustment of piston clearance would then be useful in compensating for the inherent compression ratio decrease that occurs with increased piston phase angle (reduced port overlap). Furthermore, operation at high altitude is accompanied by reduce intake pressure, which makes the engine more tolerant to high compression ratios.

The opposed piston engine of my invention has double acting pistons which provide internal scavenge air compression in phase with port opening. Such scavenging produces an additional benefit. Higher charge air pressures normally increase engine parasitic pumping power in two-stroke operation because of increased charge density during the compression stroke. Such power is not fully recovered in the power stroke or exhaust turbine. In the double-acting arrangement of my invention, increased external charge pressure acting on the underside of the piston during compression partially compensates for such additional piston compression work such as that which occurs in a four-stroke-cycle engine. As a result, the net compression work in the cycle resulting from increased charge densities is reduced. When an exhaust-driven turbocharger is used, power is thereby recovered from normally wasted exhaust gas energy, not only in the form of increased charge compression but also by the addition of pneumatic power to the pistons in the direction of increased shaft output. Thus, a form of bottoming-cycle compounding is achieved in the engine of my invention.

In the engine of my invention, piston clearance and phasing can be continuously, independently and simultaneously varied to optimize engine performance at any combination of load, speed and altitude. Maximizing compression ratio maximizes thermal efficiency subject to structural constraints. Increasing clearance volume increases engine power potential subject to peak pressure constraints. Reducing port overlap also increases engine power potential and reduces fuel and air consumption.

These objects and advantages of my invention are combined to achieve a heat engine having superior characteristics for lightweight, high-altitude, subsonic aircraft propulsion as compared with engines of prior art construction. For example, my invention enables the achievement of propeller driven aircraft of lighter weight, greater range, longer flight endurance and greater flight-worthiness by virtue of the advantages it offers in a lightweight, compact, vibrationless diesel powerplant that does not require burdensome heat rejection appurtenances. Still further advantages of my invention will become apparent from consideration of the drawings and ensuing descriptions of them.

DESCRIPTION OF DRAWINGS

FIG. 2 is a simplified schematic diagram of a four-cylinder engine assembly at Section 2—2 indicated in FIG. 1;

FIG. 3 is a pictorial illustration of a double harmonic barrel cam of the present invention, with roller followers;

FIG. 6 is a cross-sectional view of an alternate compressor cylinder head of the present invention that is along the same view line as FIG. 1;

FIG. 7 is a perspective view of the reed valve shown in FIG. 6;

FIG. 8 is a cross-sectional view of the compressor cylinder head at section 8—8 as indicated in FIG. 6;

FIG. 9 is a cross-sectional view of the compressor cylinder head 6 at section 9—9 as indicated in FIG. 6;

FIGS. 14A, 14B and 14C show the formation and structure of an alternative form of nozzle producing a flat fan type of spray;

FIGS. 18A, 18B and 18C illustrate various spray patterns provided by the injection nozzle of FIG. 17;

FIGS. 19A, 19B and 19C illustrate additional structural features which may be included in the injection nozzle of FIG. 17 to provide various axi-symmetrical jet patterns;

DESCRIPTION AND OPERATION OF INVENTION

Figure 1:
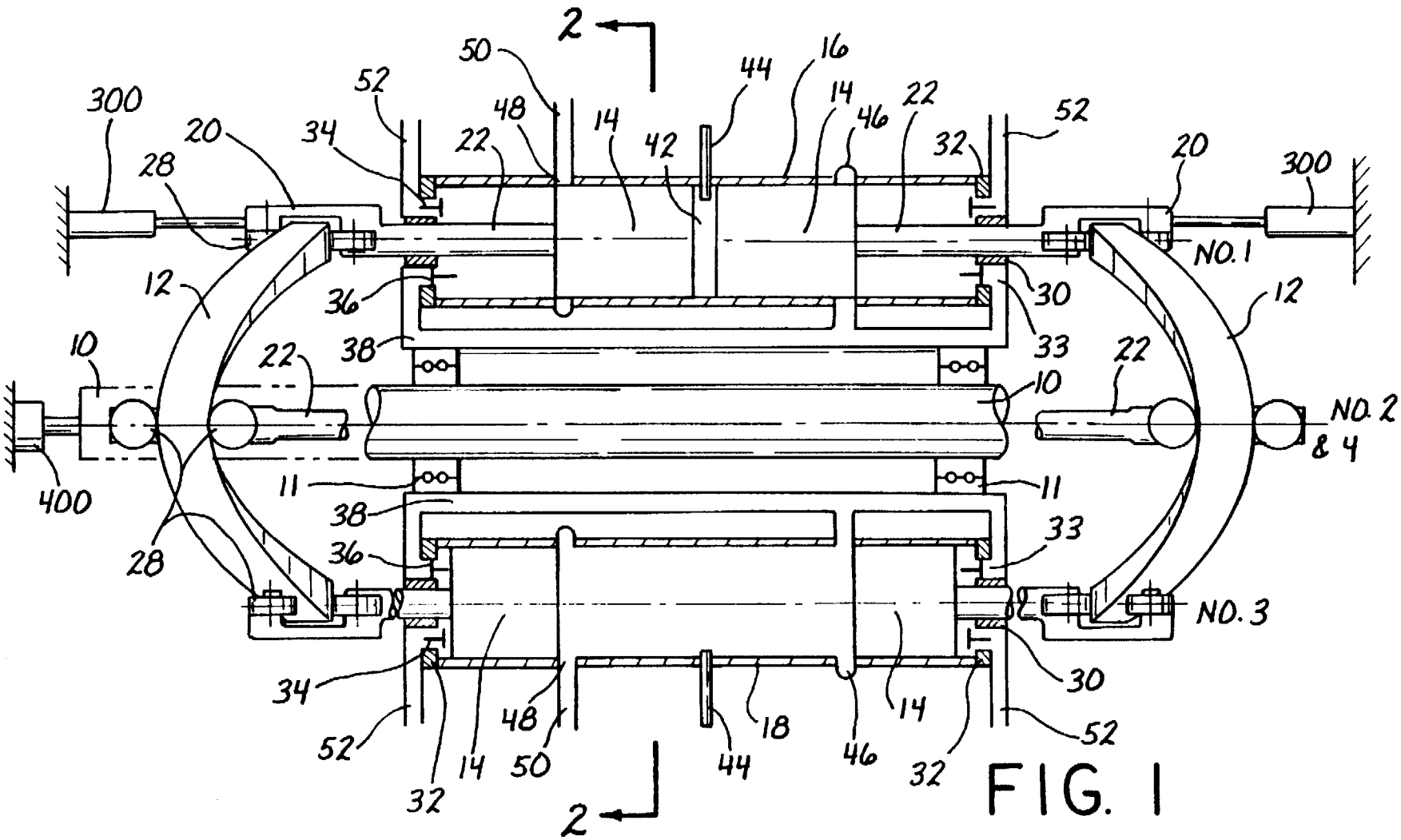
FIG. 1 is a simplified section and cutaway view of an engine assembly constructed according to the present invention showing the axial-cylinder, opposed-piston layout utilizing twin, double-harmonic cams.

FIG. 1 shows a simplified longitudinal section and cutaway view of the engine assembly of the present invention.

Shaft 10 passes axially through the center of the assembly, is carried by a pair of bearings 11 in a fixed axial position and mounts a pair of double-harmonic barrel cams 12, one fixed on each end. Cams 12 are radially and axially indexed and placed on shaft 10 with respect to opposed piston pairs 14 such that piston pairs 14 of diametrically opposite cylinders 16 and 18 are in approximately the same position with respect to the center of their respective cylinders so that there is axial and longitudinal symmetry at all times. Cams 12 may be located on shaft 10 with a small angular displacement with respect to each other in order to cause one of piston pairs 14 to be displaced in the cylinder slightly ahead of its opposite. This asymmetric piston phasing feature will be explained more fully in the following in connection with scavenging operations.

As discussed above, opposed pistons 14 in diametrically opposite cylinders are in approximately the same position for purposes of axial and longitudinal symmetry. However, in FIG. 1 cylinder 18 is shown as though shaft 10 had been rotated 90° from the actual position shown. In FIG. 1 opposed pistons 14 are located in cylinder 16 (denoted as No. 1) at their innermost positions as determined by their respective cam follower assemblies 20 which straddle cams 12 and act on pistons 14 through piston rods 22. As shaft 10 is rotated through a 90° angle the followers are displaced in equal and opposite directions by an amount equal to the amplitude of cams 12, which determines the stroke of each piston 14. The positions of pistons 14 at this position (90° out of phase) is indicated by the illustration of cylinder 18 (denoted as No. 3) in FIG. 1 which shows opposed pistons 14 in their outermost positions. Further, rotation of shaft 10 causes pistons 14 to move in and out synchronously and cyclically such that pistons 14 traverse cylinders 16 and 18 in and out four full strokes for each complete revolution of the shaft 10.

Pairs of cylinders 16 and 18, such as those designated Nos. 1 and 3 in FIG. 1, which are symmetrical about the shaft 10, are fully balanced dynamically in that all motions of reciprocating masses are in equal and opposite directions and pairs of diametrically opposite cylinders 16 and 18, like those denoted Nos. 1 and 3, are symmetrical about the shaft axis of the engine. Additional pairs of cylinders 16 and 18, e.g. Nos. 2 and 4, may be disposed about the shaft, as in the four cylinder arrangement shown in FIG. 2, without disturbing the balance of the engine. The cam and follower arrangement corresponding to the layout of FIG. 2 is indicated in FIG. 1, where the cylinder pair out of plane are denoted Nos. 2 and 4.

Figure 4:
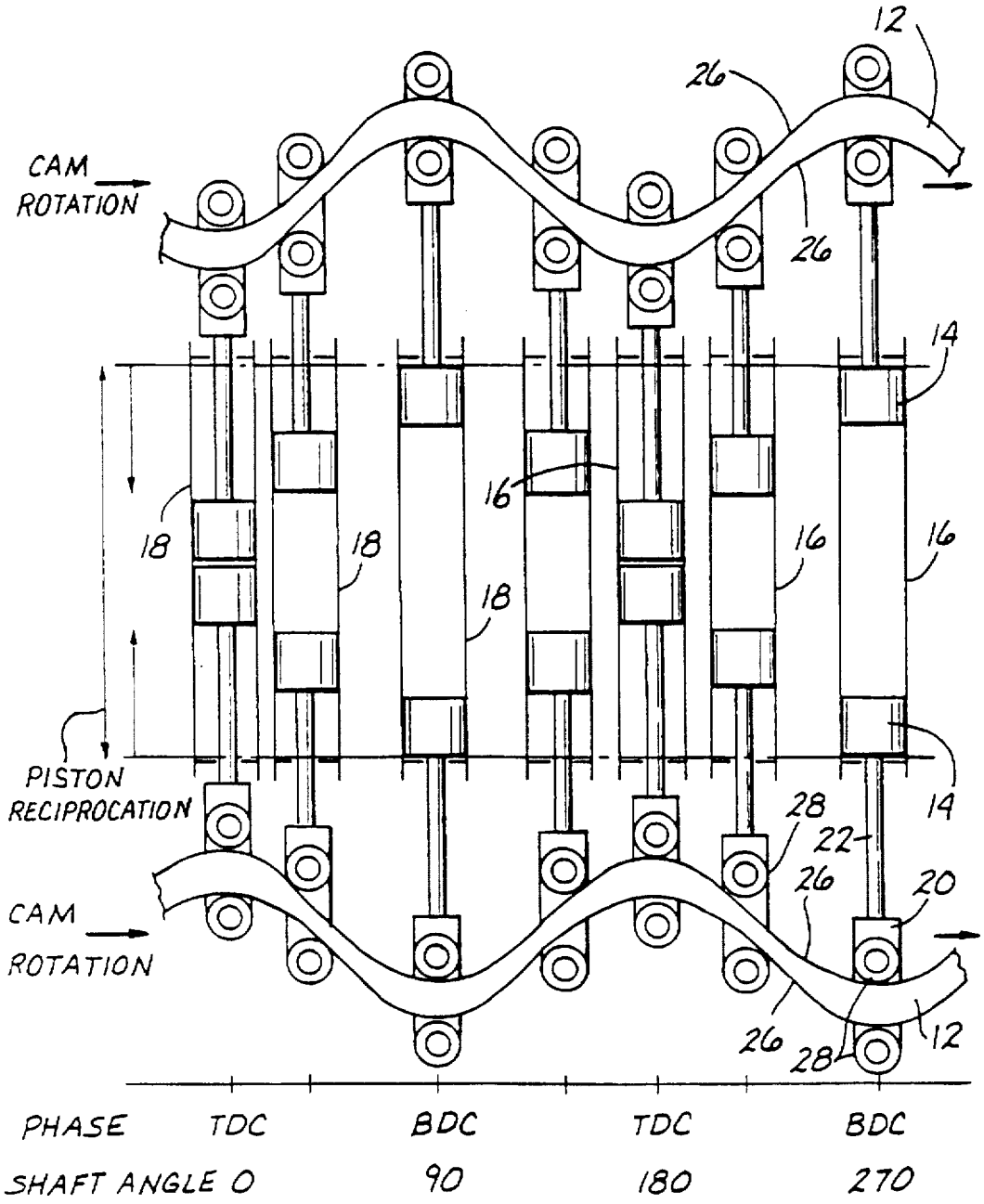
FIG. 4 is a planar schematic diagram illustrating the geometrical relationship between piston motion and shaft rotation provided by the twin, double-harmonic cam and opposed piston arrangement of the present invention.

Cams 12 shown in FIG. 1 are illustrated in FIG. 3 as having a cylindrical periphery 24, the radial faces 26 of which are contoured to produce simple harmonic motion in the axial direction of the fixed-center roller followers 28 which straddle cams 12 in their follower assemblies 20. As described above, the cam profiles describe two complete cycles per revolution and are thus double harmonics. FIG. 4 illustrates how this harmonic piston motion is developed by showing the peripheral line of contact as if it were in a plane so that rotary motion can be depicted in a linear fashion. Note that as roller followers 28 straddle cam plate 12 they are constrained to reciprocate linearly as cam 12 rotates. Axial constraints are provided by pistons 14 in their cylinder bores 16 and 18 and piston rods 22 which have crosshead bearings 30, as shown in FIG. 1. It will also be seen that the contour of cam 12 restrains roller follower assemblies 20 from rotating about the axis of piston rod 22 and also from moving laterally when tangential forces are imparted by cam 12 on rollers 28, and vice versa.

Figure 5A:
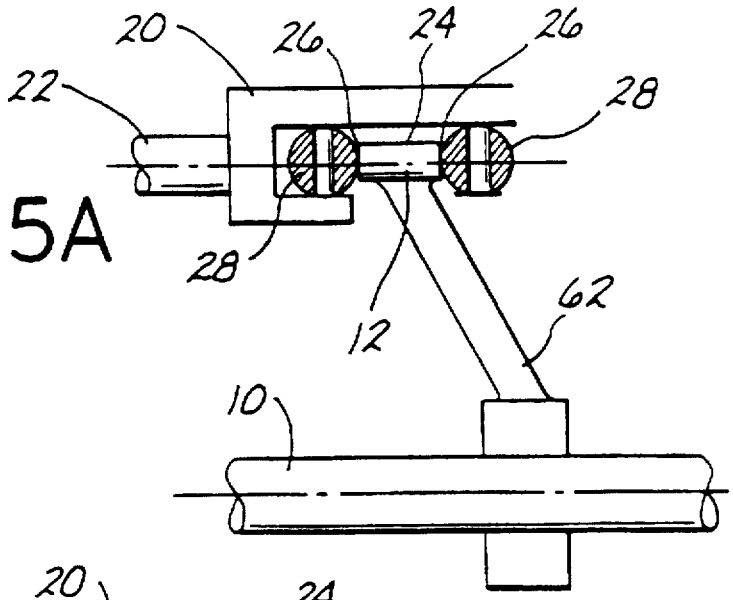
FIG. 5A shows spherically-ground roller followers riding on a narrow plane-radial cam face, in one embodiment of the present invention.
Figure 5B:
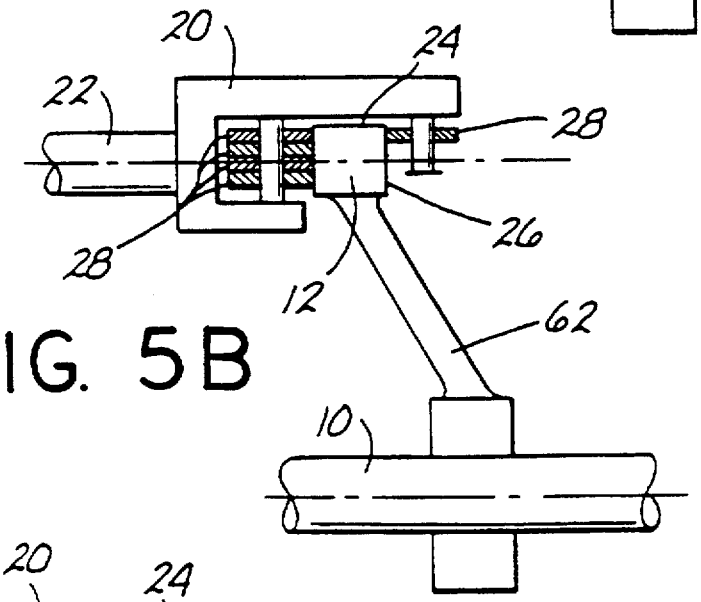
FIG. 5B shows multiple cam roller followers riding on a wide plane-radial cam face, in another embodiment of the present invention.
Figure 5C:
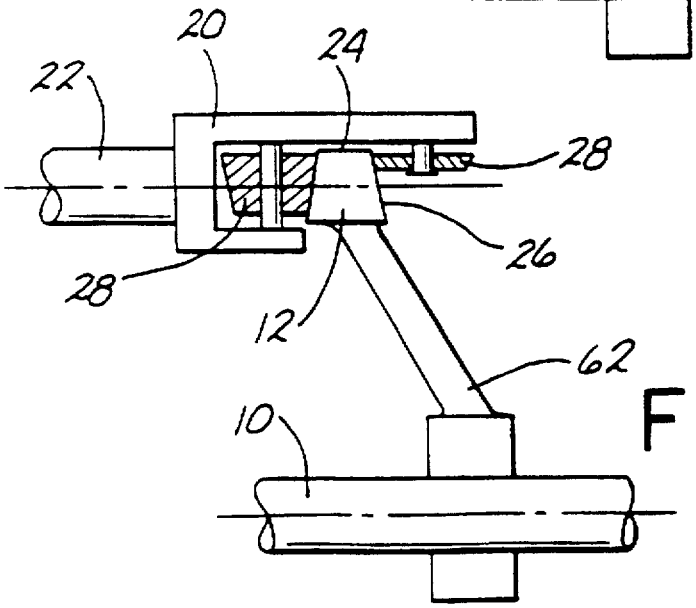
FIG. 5C shows tapered roller followers riding on a tapered cam face, in yet another embodiment of the present invention.

Cam faces 26 may be plane radial surfaces, that is, cam faces 26 may be flat and normal to the axis of rotation. Thus, the peripheral speed of cam faces 26 varies with the radius from the centerline of shaft 10 such that a rigid cylindrical roller follower 28 of finite thickness will have pure rolling contact with cam surface 26 at only one radial point. A difference in surface speed will then exist between roller 28 and cam surface 26 inside and outside this contact point, resulting in a condition known as scuffing. This condition can be remedied with this planar, radial surface 26 by using rollers 28 having a spherically ground surface, as shown in FIG. 5A, to contact flat cam surface 26 which may be narrow in width. When such surfaces in contact are sufficiently hard, the area of contact is very small and differential motion or scuffing is negligible. An alternative configuration that reduces the scuffing tendency is shown in FIG. 5B. When a wider cam face 26 is used, there is a greater area of contact. Multiple rollers 28, that are free to rotate at differing velocities, are used to reduce stress concentration. Yet another low-scuff configuration is shown in FIG. 5C which utilizes tapered roller 28 that contacts tapered cam face 26 at a single line of contact. The taper of rigid roller 28 allows it to contact cam face 26 in a line without scuffing because its diameter increases with the radius of cam contact at such a rate that its peripheral speed can match the peripheral speed of cam surface 26 at every point along its line of contact.

FIG. 1 also shows that pistons 14 are designed to be double-acting by enclosing the outer ends of the cylinders 16 and 18 with head 32 that contains crosshead bearing and sealing gland 30 as well as automatic valving 34 and 36 to accomplish compressor operation. When piston 14 moves inward, a suction develops behind it which opens spring-loaded poppet valve 34 controlling the scavenge air intake port 52, admitting air into the cylinder. When piston 14 moves outward, pressure develops ahead of it causing scavenge air intake valve 34 to close and scavenge air discharge valve 36, also shown as a spring loaded poppet, to open allowing flow to discharge through discharge port 33 into charge air manifold 38 under pressure.

In another exemplary embodiment, automatic valving 34 and 36 in FIG. 1 may be of the reed type having improved flow and inertia characteristics compared with the spring-loaded poppet types shown therein. This embodiment is shown in FIG. 6 and comprises double-reed valves 35 and 37 that are formed from thin metallic sheet of suitable spring material into a V-shaped structure having a radius at the apex 39 the V. FIG. 7 shows reed 41 thus formed serves both suction valve 35 and discharge valve 37. FIG. 6 shows reed valves 35 and 37 to be closely fitted into rectangular-section channels 43 and 45 such that tips 47 and 49 are preloaded outwardly against wide-side channel walls 51 and 53 (See FIG. 6). Reed widths are sized such that edges 55 and 57 conform to narrow-side channel walls 59 and 61 with a close, sliding fit (See FIG. 8).

Such a structure permits flow only in the direction from the apex 39 to the tips 47 and 49 in the following manner. A gap is created between reed tips 47 and 49 and wide-side channel sides 51 and 53 resulting in a rectangular flow area at each tip 47 and 49 whenever a pressure difference is manifest across the reeds in the flow direction and that pressure difference exceeds the preset valve of pressure difference required to overcome the elastic pre-load holding reeds arms 63 and 65 outward against side walls 51 and 53. The pressure difference acting on the projected area of the reed arms 63 and 65 produces bending in those arms about apex 39. When the pressure difference is in the flow direction, substantial inward flexural deflection of the reeds occurs about apex 39 allowing tips 47 and 49 to move away from walls 51 and 53 thereby opening a flow passage comprising the gap between reed tips 47 and 49 and walls 51 and 53. When the pressure difference is in the opposite direction, tips 47 and 49 are forced more heavily against walls 51 and 53 thereby preventing flow in that direction.

As shown in FIG. 6, reeds 35 and 37 are captured by pins 67 and bars 69 preventing displacement of the reeds within the channels 43 and 45 under the impetus of pressure differences in either direction. Suitable reed material is represented by lightweight, heat-and-corrosion-resistant, high-fatigue-life, low-elastic-modulus wrought alloys such as titanium Ti-6Al-4V and ASTM B194 beryllium/copper.

Identical reeds 41 serve for both suction valve 35 and discharge valve 37. For the suction valve 35, reed 41 is installed with its apex pointed toward suction port 52. For discharge valve 37, reed 21 is installed with its apex pointed away from discharge port 33 and toward cylinder 16. As a result, suction reed 35 allows cylinder 16 to fill only from suction port 52 whereas discharge reed 37 allows cylinder 16 to empty only into discharge port 33. Furthermore, when the pressure at the suction port 52 exceeds the pressure at discharge port 33 by a certain amount, flow is permitted to pass through both reeds in series.

The preferred reed valve construction described above conforms to a rectangular passage of high aspect ratio as shown in FIG. 8. The rectangular ports 71 shown therein have a width "w" that is made somewhat greater than the height "h" in order to achieve the maximum flow area and reed projected area within the circular outline of the cylinder head. This plan obtains the greatest flow potential and transient response for the passage cross section available. The resulting space available for the location of the piston rod crosshead bearing 73 is best utilized by a rectangular piston rod 75 and crosshead bearing members 77 and 79 conforming to a rectangular section as well.

The alternative rectangular section piston rod 75 shown in FIG. 8 provides several other benefits not available with cylindrical piston rod 22 shown in FIG. 1. One advantage is that the cross sectional area available for the valves 35 and 37 is increased enabling improved engine breathing. Another is that the structural properties of rectangular section piston rod 75 are better suited to the loads imposed on it by barrel cam 12 and followers 20; namely, enhanced bending strength in one transverse plane and greater column stability in overall compression. Another advantage of rectangular piston rod 75 is its ability to provide angular restraint to the piston/rod/cam-follower assembly (see FIG. 1) thereby eliminating the need for the separate roller guide arrangement of FIG. 21 below (comprising guide roller 68 and guide rail 70) to prevent any rotational chattering tendencies that may arise due to possibly uneven contact between the cam follower roller surfaces. Yet another advantage is the use of planar crosshead bearings 77 and 79 which have greater linear sliding load-bearing capacities and more facile service characteristics than cylindrical journals.

Figure 10:
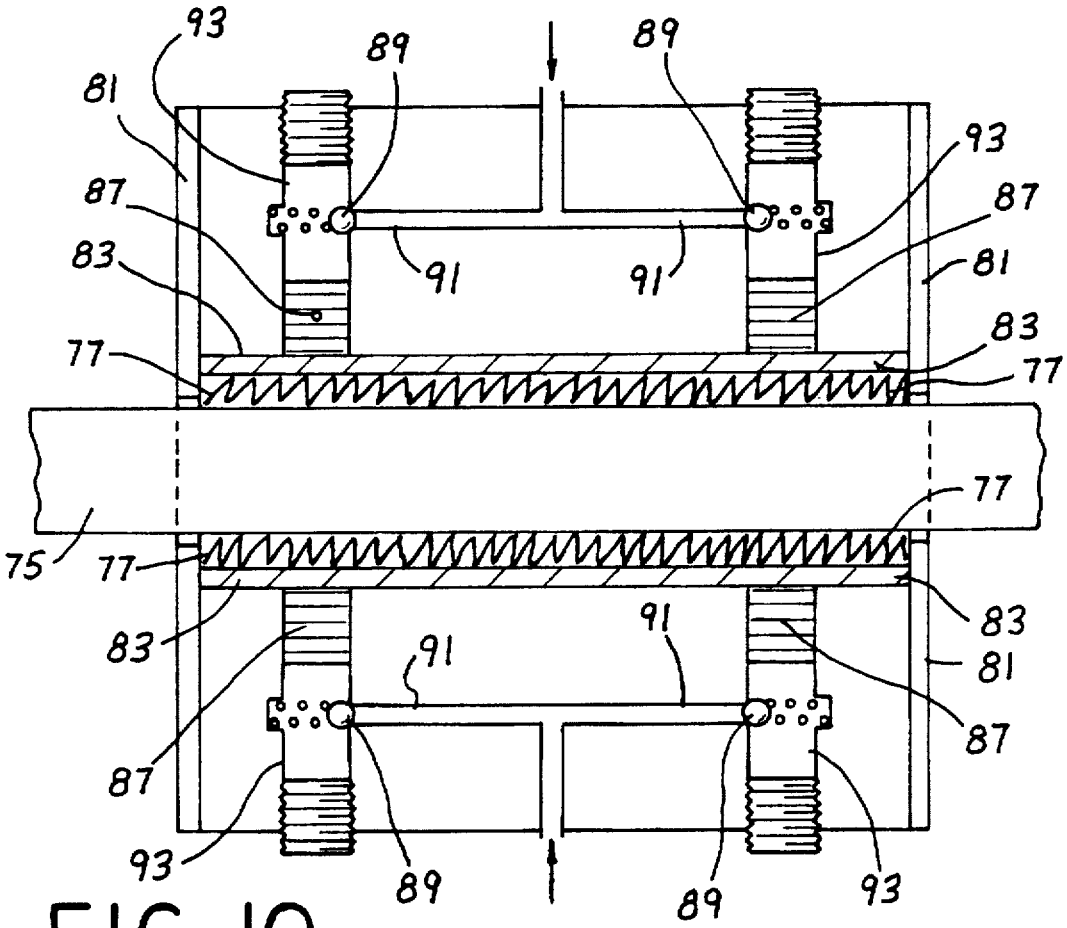
FIG. 10 is cross-sectional view of an alternate embodiment of the compressor cylinder head of FIG. 6 but which includes hydraulically preloaded crosshead bearings.

The rectangular crosshead bearing shown in FIGS. 6 and 8 comprises adjustable and easily replaceable floating brushes 77 in contact with the loaded sides of the piston rod 75 (the narrow side). These brushes may be made of various strong, low-friction, self-lubricating materials such as polycrystalline graphite, Molalloy™, gray cast iron, aluminum bronze or various other low-friction materials. As shown in FIG. 9 these floating brushes 77 are captured axially and tangentially between end plates 81 and side plates 79 and may be supported radially by preloaded plates 83 that provide running adjustment for wear thereby avoiding the development of excessive clearances. One means of preloading plates 83 shown in FIG. 9 uses compression springs 85. Another means is shown in FIG. 10 which uses hydraulic pressure from lubricating oil applied to pistons 87 which bear on backing plates 83. The effectiveness of this structure for maintaining adequate bearing clearance adjustment is enhanced by providing check valves 89 in the oil supply passages 91 feeding the cylinders 93 containing the pistons 87 whereby movement of the brush backing plates 83 is allowed only in the direction opposing the slack that develops from wear. A small amount of oil leakage around pistons 87 may be allowed to provide lubrication cooling of crosshead bearing members 77 and 79.

The other end of the pistons 14, at the center of the cylinder 16 or 18, forms combustion chamber 42 of the engine. Opposed piston pairs 14 come together in the center of the cylinder where fuel injection 44 and/or ignition means are located. Note in FIG. 1 that cylinders 16 and 18 are provided with peripheral ports 46 and 48 located in the space between opposed pistons 14, just inside the outermost point of their travel. Thus, ports 46 and 48 are opened and closed by the piston motion in the neighborhood of their outermost positions. Ports 46 located at one end are manifolded to the charge air manifold 38 and thus function as charge air admission ports. Ports 48 are manifolded to exhaust ducting 50 and function as combustion gas exhaust ports. Ports 46 and 48 are opened on the outward movement of the pistons on every stroke allowing air to pass into cylinder 16 or 18 at one end and combustion gases to exhaust from the cylinder at the other end. This accomplishes a uniflow type of cylinder scavenging which is the most complete and efficient process known for that purpose. As will be described more fully in the following, the arrangement of FIG. 1 accomplishes a self-aspirated, uniflow-scavenged, two-stroke cycle heat engine process every half revolution of its shaft when proper means, as are known in the art, for admitting fuel and igniting the same are provided. Moreover, such a two-stroke cycle is performed by each piston 14 in every cylinder such that piston 14 delivers two power strokes per shaft revolution. Furthermore, pairs of cylinders will deliver eight complete power strokes per shaft revolution.

Figure 11:
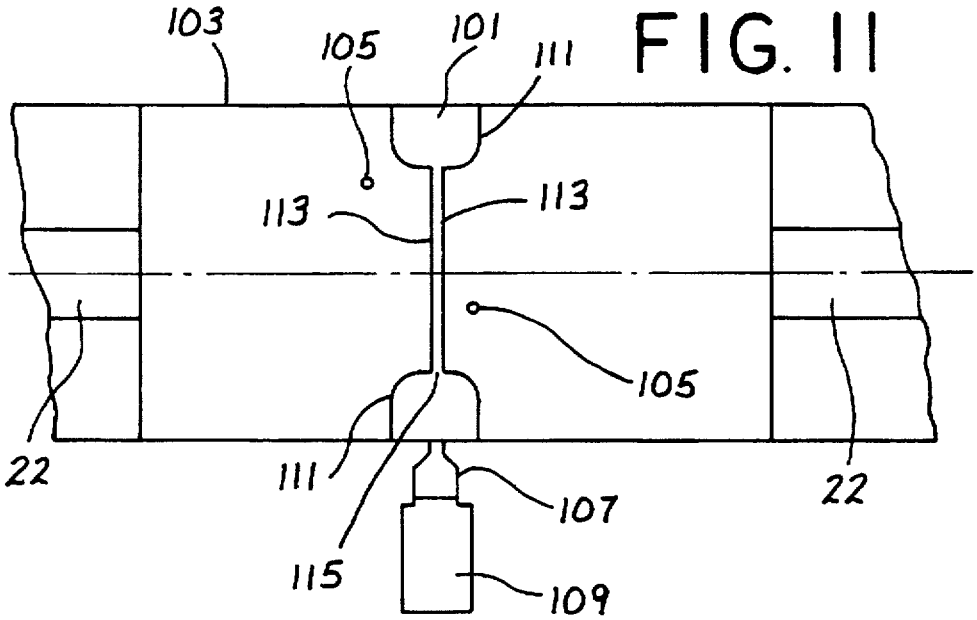
FIG. 11 is an axial cross-section of an alternate embodiment of the combustion chamber of FIG. 1 that is taken along the same view line.

FIG. 1 shows cylindrical disk combustion chamber 42 formed between opposing flat-topped piston pairs 14 as they approach each other on their inward travel. This configuration utilizes a relatively large piston clearance 42 and radially disposed, flush mounted injectors 44. An alternative combustion chamber configuration is shown in FIG. 11 that facilitates improvements in the various factors affecting the quality of fuel injection, ignition, combustion, and air utilization relating to the attainment of high engine performance with low exhaust emissions. As shown therein, the shape of combustion chamber 101 is determined by the cylinder bore 103, the contour of the piston crowns 105 and any antechambers 107 that may be provided for the installation of fuel injectors 109 or the like.

Figure 12:
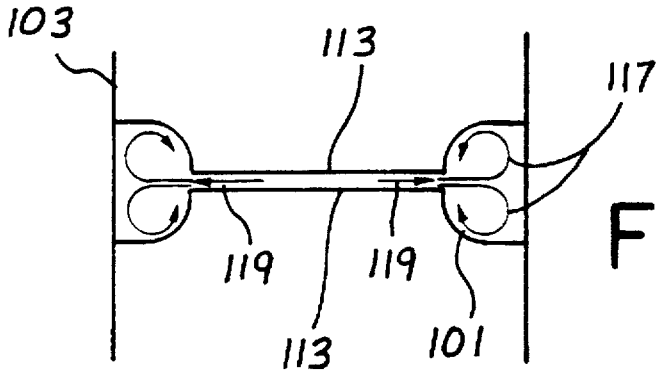
FIG. 12 is axial cross-section of the combustion chamber of FIG. 11 showing the charge motion.

The alternative combustion chamber design shown in FIG. 11 is a semi-torus formed by a peripheral relief 111 provided around the outer perimeter of each piston crown 105. This arrangement leaves a large central surface or squish land 113 on each piston crown 105 permitting a small piston clearance 115 to be used for the purpose of generating a strong, radially-outward flow (squish) as the pistons approach each other in their cyclic motions. As illustrated in FIG. 12, a double, counter-rotating swirl 117 is developed in the charge mass which is largely contained in the toroidal combustion chamber space 101. This flow pattern results from the impact of the virtually symmetrical, radially-outward squish flow 119 impacting the cylinder wall 103.

This arrangement minimizes the fraction of the charge air that is inaccessible to penetration and entrainment by injected fuel particles and also minimizes the surface area in contact with the burning charge that would have a quenching effect on combustion. The perimeter of the squish lands 113 may or may not be axi-symmetric and may or may not be circular. Accordingly, the cross-section of the toroidal space 101 may be varied from point to point about the perimeter to provide improved entrance regions for the fuel injection.

The strong squish arrangement permits the use of straight radial intake ports and radially disposed fuel injectors. Radial ports (not shown) maximize cylinder flow capacity and minimize the degree of mixing of fresh charge with residual combustion products thereby achieving the greatest degree of scavenging with the least air supply penalty. The strong radially-outward squish flow accompanied by the strong, swirling charge motion minimizes injection spray penetration requirements thereby permitting the use of lower injection pressures and velocities while also reducing the tendency for injected fuel to impinge on combustion chamber surfaces before inflammation.

The squish-only arrangement described above favors the use of radially disposed fuel injectors equipped with nozzles that can atomize and distribute the fuel spray in a flat fan pattern symmetrically about the injector axis in the plane of the torus. Such a pattern maximizes contact of fuel and air for best ignition, combustion and ignition performance.

Figure 13A:
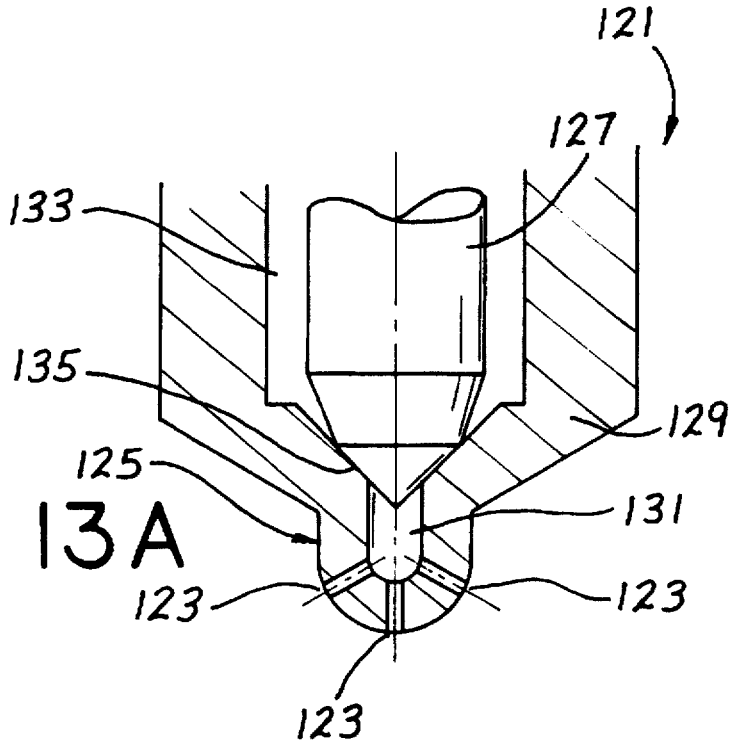
FIG. 13A is a partial section of an exemplary embodiment of a hole type injection nozzle of the present invention.
Figure 13B:
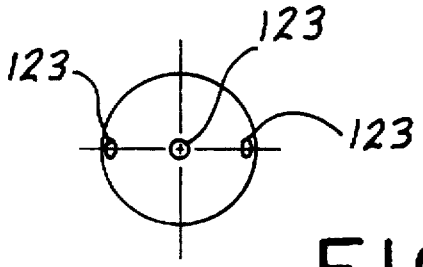
FIG. 13B is a plan view of the tip of the nozzle of FIG. 13*a* showing the tip holes located in a single plane.

A hole-type nozzle that approximates such a pattern is illustrated in FIGS. 13A and 13B. Nozzle 121 provides small holes 123 drilled through injector tip 125 at various angles with the axes of all holes 123 drilled in the plane of the torus. FIG. 13A shows a partial section of hole type injection nozzle tip 125 having needle 127 seating in body 129 forming cup 131 into which holes 123 are radially drilled. FIG. 13B presents a plan view of tip 125 showing holes 123 located in a single plane. Needle valve 127 opens inwardly when sufficient injection pressure is applied to body space 133 allowing flow into cup 131 feeding holes 123. A fraction of the injection pressure is throttled across the needle seat 135 and the remainder produces efflux through holes 123 in the form of small pencil streams that break up into particles of various sizes at a short distance from the tip 125 depending on the efflux velocity produced. Such efflux velocity is proportional to the square root of the pressure difference prevailing across the holes 123. Since the holes sizes are fixed thus fixing the flow area, the flow rate is also proportional to the square root of the pressure differential. Thus, low flows have low velocities and high flows may require excessive pressures.

An alternative form of nozzle producing a flat fan type of spray as a sheet of particles is shown in FIGS. 14A, 14B and 14C. This nozzle produces a much finer and more uniform spray pattern with higher velocities because it opens outwardly without throttling providing a flow area that is proportional to the injected flow rate. Consequently, it delivers a high velocity spray at all flow rates and requires only a small range of pressures for a wide flow range. As shown in FIG. 14A the nozzle is formed from a short section of thin-wall metallic tubing 137 of suitable material which is triangularly notched 139 and lapped to form a closely fitted joint such that the outward facing perimeter of the tube is closed when lapped surfaces 141 are pressed together as shown in FIG. 14B. The open end of the tube 137 is squared 143 with the axis 145 by removal of material 147 and then, as shown in FIG. 14B, held tightly in place by collet 149 against tapered plug 151. Collet 149 bears against the outside perimeter of tube halves 153 at a point 155 outboard of the point 157 where the tapered plug 151 contacts the inside perimeter of the tube halves 153. The tapered plug 151 is tapered at a greater angle than the inside surface of the tube-halves when closed such that tightening of the collet 149 forces the tapered plug against lapped sealing surfaces 159 on injector body 161 as well as against the inside surface of the tube-halves 153 around the inner perimeter of the inboard extremity of the tube 157. In addition, the peripheral pressure of the collet 149 against the tube halves 153 reacted to by the offset inside support of the tapered plug 151 pre-loads the tube halves 153 together along their angularly cut and lapped surfaces 141 to completely seal the assembly against external leakage up to a given pressure. Above such a predetermined interior pressure, sufficient hoop and bending stresses are developed in the tubing halves 153 to overcome the pre-load and deflect them outwardly apart thereby opening the slit 163 at the lapped joint of the tubing halves 153 forming a variable area nozzle. The opening pressure setting may be adjusted by varying the amount of torque applied to the collet 149 which, in turn, varies the clamping force holding tubing halves 153 together along lapped surfaces 141. The tapered plug 151 also functions to displace fluid from the interior volume between tube halves that is subject to compressibility effects which detract from the precision of injection transients. FIG. 14C shows an outboard profile of the injector and the flow pattern 165 it produces.

Figure 15:
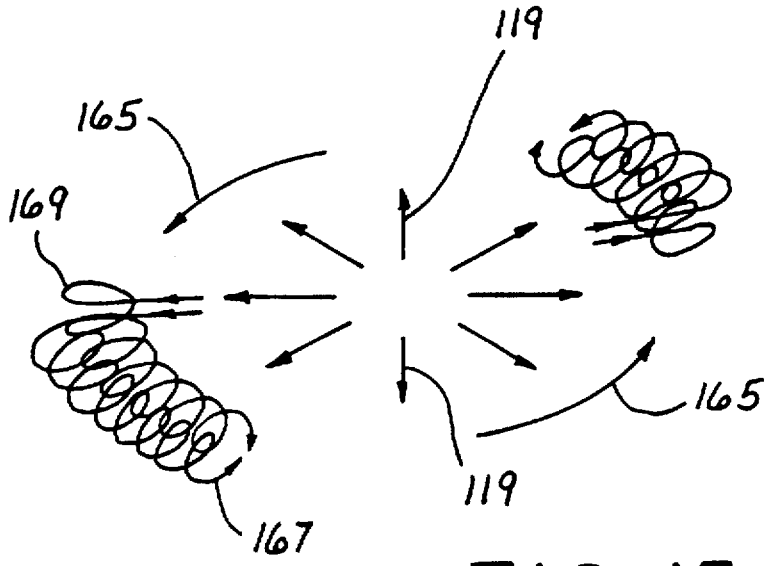
FIG. 15 is a pictorial view of the charge motion in the toroidal combustion chamber of FIG. 12.

The toroidal combustion chamber shown in FIG. 12 facilitates an alternative charge motion pattern when tangential swirl motion is created in the intake charge. Such charge motion is readily produced in the opposed-piston uniflow engine configuration of the present invention by inclining the intake ports at an angle to the cylinder diameter thereby introducing a tangential component to the flow entering the cylinder. This type of charge motion increases mixing which can have scavenging benefits under some engine operating conditions. FIG. 15 presents a pictorial view of the charge motion in the toroidal chamber when the strong squish motion 119 produced by the opposed pistons (see FIG. 12) interacts with the strong tangential swirl motion 165 produced by the tangentially disposed intake ports. As illustrated in FIG. 15, the resulting flow pattern comprises double, counter rotating vortices 167 and 169 that travel spirally around the toroidal combustion chamber space, circulating in the direction of the intake swirl 165.

Figure 16:
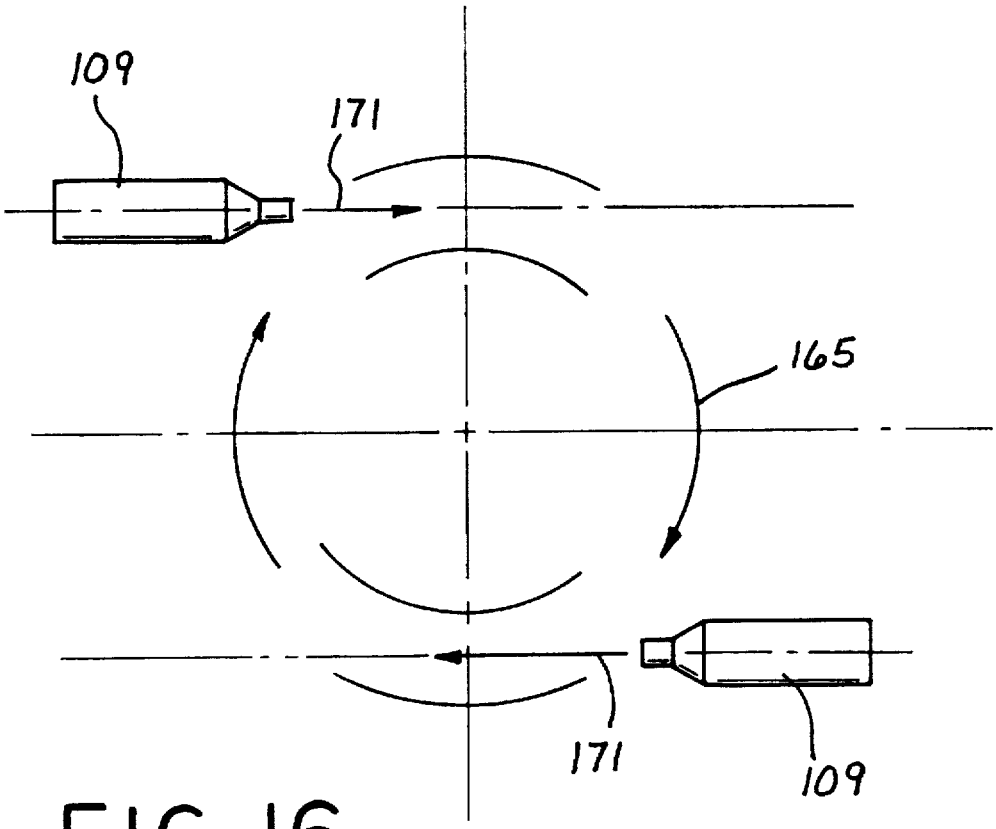
FIG. 16 is a transverse cross-section of the combustion chamber of FIG. 12 showing tangentially disposed fuel injection nozzles.

This type of charge motion facilitates tangentially disposed fuel injection nozzles as shown in FIG. 16. Fuel injectors 109 inject fuel jets 171 that are tangential to and in the direction of the swirl flow 165 which not only boosts the rate of swirl circulation but also improves the chances for slower-moving and later-injected fuel particles to contact charge air prior to the build-up of the combustion products of the faster-moving and earlier-injected fuel particles that ignite sooner and penetrate farther into the charge mass and are thereby exposed to a greater fraction of the oxygen content of the charge. The double vortex charge motion pattern (FIG. 15) aids the entrainment, mixing and oxygen contact and therefore the ignition and reaction speed of the entire range of fuel particles sizes and velocities produced by the injector nozzles. This occurs in part by virtue of the longer mean flow paths through the charge mass that can be produced for all the fuel particles prior to impinging on combustion chamber surfaces and/or experiencing the onset of expansion. Obviously, any number of injectors may be placed around the perimeter of the opposed piston combustion chamber. Single hole and inward-opening pintle type nozzles as are common in the prior art may be used.

Figure 17:
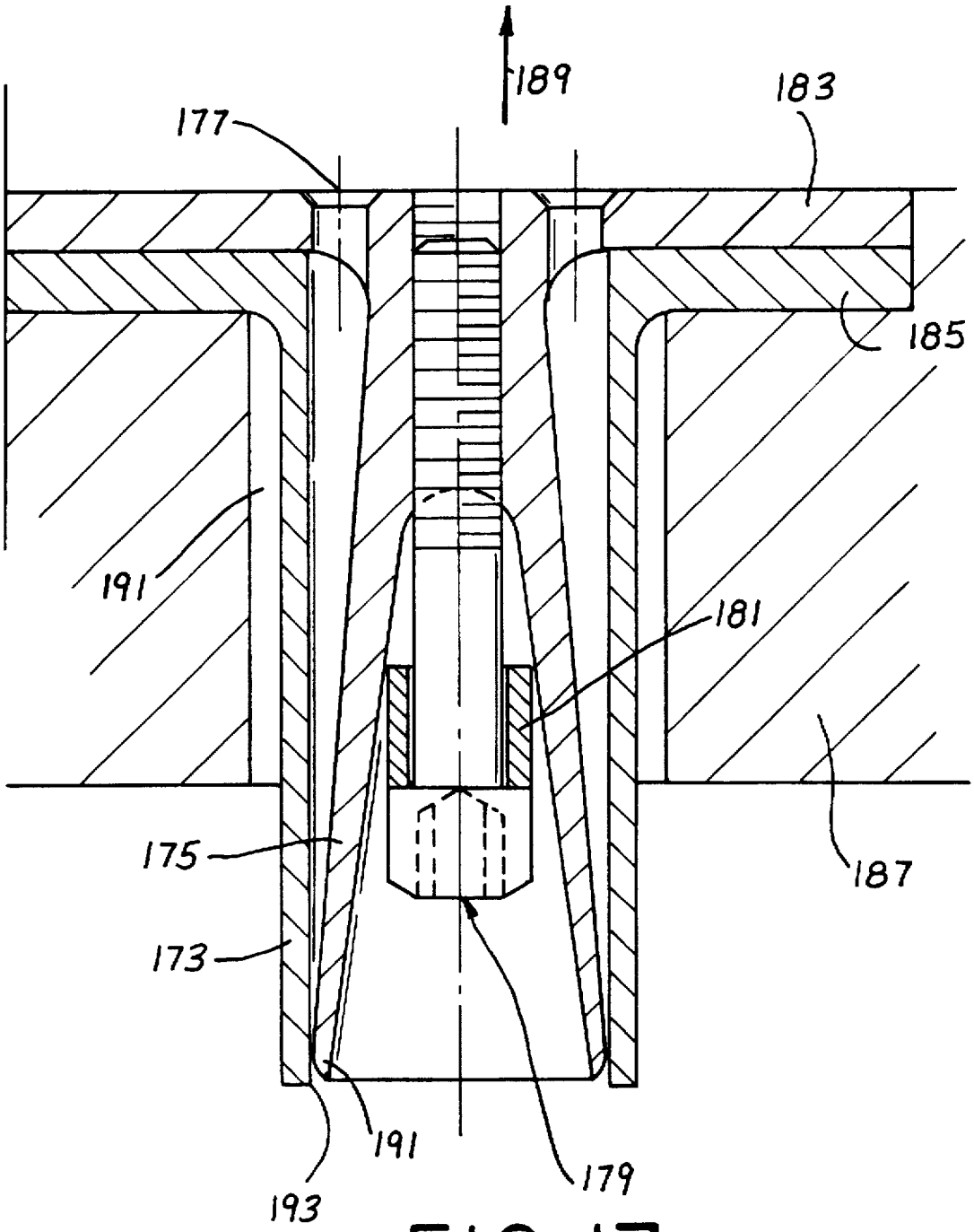
FIG. 17 is an alternative form of injection nozzle which has advantages for the tangentially disposed injector arrangement of FIG. 16.

FIG. 17 illustrates an alternative form of injection nozzle which has advantages for the tangentially disposed injector arrangement used with the swirl circulated combustion chamber. This nozzle is also of the outward-opening, variable-area type and also utilizes a flexing tubular structure. It comprises a flanged outer tube 173 into which is fitted a flanged inner body 175 incorporating chamfered holes 177, cap-screw 179 and wedge bushing 181. The flanges 183 and 185 register and align the nozzle assembly and seal it against external leakage when clamped between the injector body (not shown) and the nozzle holder 187 such that holes 177 allow fluid communication between the injector 189 and the small volume annular space 191 provided between the outer tube 173 and the inner body 175. In this nozzle arrangement, the outside perimeter of the outer extremity of the inner body 191 is forced into contact with the inside perimeter of the outer extremity of the outer tube 193 by elastically deflecting the inner body outward when bushing 181 is wedged against the conical contour of the inner bore of the inner body 175 by tightening cap screw 179. By such means a pre-load between outer tube 173 and inner body 175 is created. This pre-load determines the minimum pressure level that must be developed in annular space 191 before bending and hoop stresses outward in the tube 173 and inward in the body 175, are sufficient to overcome the pre-load and deflect these parts apart at their extremities to create a gap forming an annular nozzle area at tips 191 and 193. The area of the gap developed will be directly related to the flow produced at the pressure applied. Thus, unlike a hole nozzle, efflux velocities will be high at all flow rates and the range of pressures required for a large range of flow rates will be limited.

The jet pattern produced by this nozzle structure is normally a thin axi-symmetric sheet in the form of a divergent hollow cone, a convergent (impinging) cone or a straight hollow cylinder as shown in FIGS. 18A, 18B and 18C, respectively. As indicated therein, spray patterns 195, 197 and 199 are produced by varying the geometry of contact between tips 193 and 191 of the outer tube 173 and inner body 175 affecting the angle of efflux. Although the jet patterns normally produced are axi-symmetric, this nozzle structure may also incorporate various baffles, tabs, hoods, slots and the like by which means asymmetrical jet patterns can be produced to accommodate other combustion chamber configurations. For example, the arrangement shown in FIG. 19A provides a baffle 197 that produces a pair of sheets 199 and 201 that diverge in one plane and are void in the orthogonal plane. Such a pattern approximates a flat fan configuration. The arrangement shown in FIG. 19B provides a tab 203 on one side of nozzle 160 which produces a flattened sheet jet 205 that is diverted to one side. The arrangement shown in FIG. 19C extends a portion of the outer perimeter of outer tube 173 that provides hoods 207 which combine the features of FIGS. 19A and 19B to converge the jet in one plane while diverging it in another. This structure also approximates a flat fan jet pattern.

The firing order of the engine of the present invention may now be described as follows. Pairs of diametrically opposite cylinders, 16 and 18, such as Nos. 1 and 3 shown in FIGS. 1 and 2 are fired simultaneously. Thus a two cylinder embodiment would fire twice per shaft revolution at shaft angles 0° and 180°, etc. This firing order may be seen by reference to FIG. 4 which shows pistons 14 in cylinders 180° apart are at their innermost travel at the same time and such positions are repeated every 180° of shaft rotation. The firing order of the four-cylinder embodiment depicted in FIG. 2 would be Nos. 1 and 3 firing at 0°, 180°, 360°, etc. and Nos. 2 and 4 firing at 90°, 270°, 450°, etc. From this it is clear how the firing order is developed for 6, 8, 10 and larger numbers of cylinder pairs of equal spacing as may be embodied in the engine of the present invention.

As indicated previously, cams 12 may be fixed to shaft 10 with a small angular difference between them. This allows piston 14 controlling combustion gas exhaust port 48 to be timed ahead of its opposed piston 14 which controls scavenge air admission port 46. As exhaust port 48 would be opened slightly ahead of intake port 46, the cylinder pressure can be substantially relieved before intake air would be admitted to cylinder 16 or 18 through the later opening intake port 46. This type of timing substantially improves the exhaust scavenging process. It follows also that exhaust port 48 will be closed ahead of intake port 46, thereby permitting a greater degree of trapping and charging of the cylinder by the air available in charge air manifold 38. This type of port timing is known in the art as unsymmetrical scavenging and has been found to be highly effective in obtaining maximum two-stroke cycle engine performance.

Figure 20:
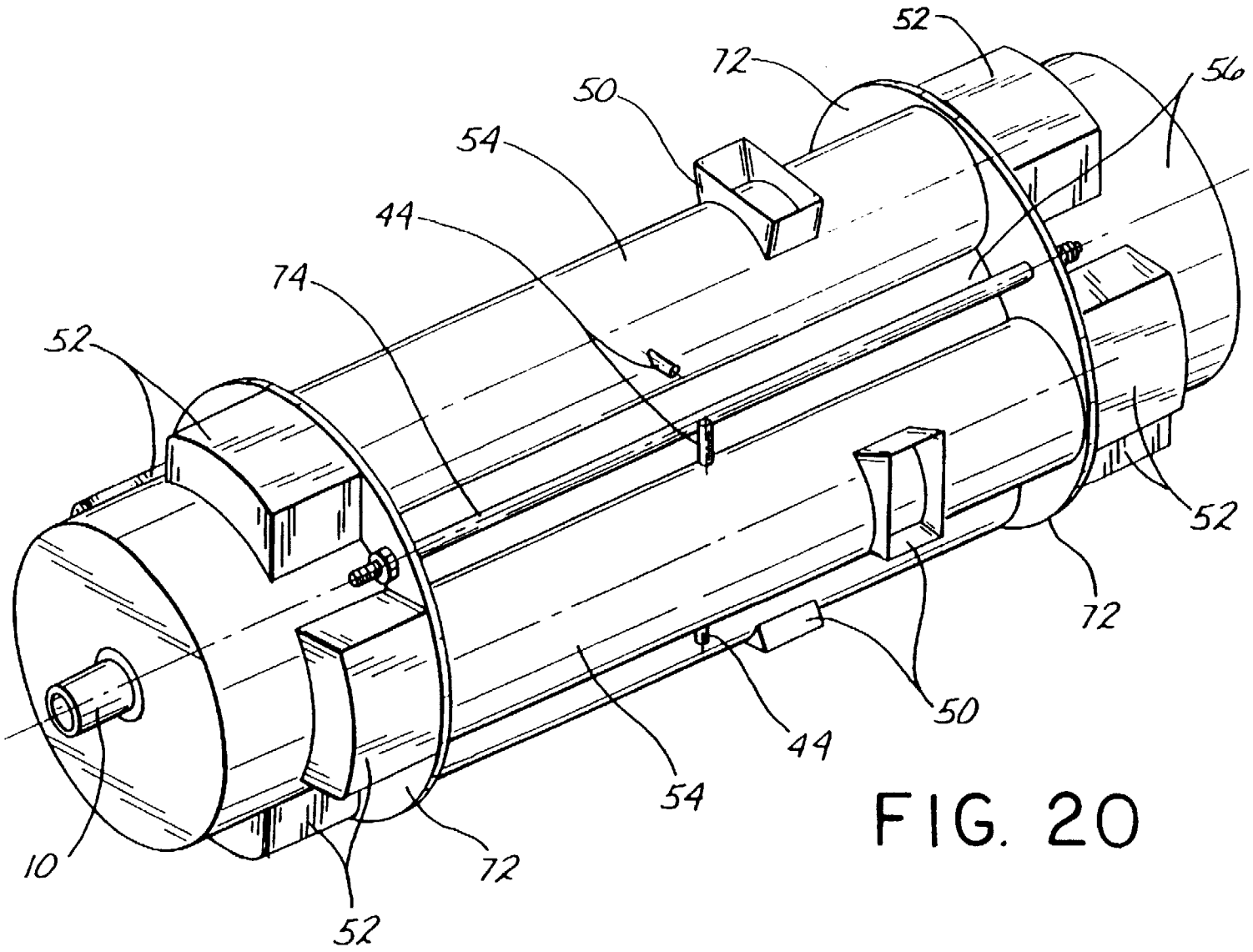
FIG. 20 shows an isometric view of the outboard profile of the engine of the present invention, showing modular cylinders mounted around an axial output shaft and the location of intake, exhaust and fuel injection features.

The configuration of the engine of the present invention as described in FIG. 1 and 2 allows separate cylinder/piston assembly modules 54 to be mounted about a central cam and shaft assembly as shown pictorially in FIG. 20. Since all pressure forces are contained within piston/cylinder modules 54, a net force can exist only along the axis of the freely moveable pistons 14 that are constrained by their cylinder bores and piston rods 22, guided in crosshead bearings 30, to move only in this manner. These axial forces vary in magnitude but do not reverse in direction because gas pressures on the pistons are such that they always act outwardly and axially. This means that the cams which restrain these forces will always be loaded axially in only the outward direction and such forces will be contained by tension within the shaft 10 connecting the two cams 12 as shown in FIG. 1. Thus, the cylinder assemblies are not subjected to any forces tending to stretch them, separate them or move them with respect to the engine assembly.

As described above, pistons 14 act on cams 12 and are acted upon by cams 12 via rolling contact followers 28. Followers 28 contact cam surfaces 26 during operation at an angle to the axis which varies according to the laws of harmonic motion. This geometry ordains that the axial force in piston rod 22 can be applied by roller 28 on cam surface 26 and vice verse, only in a direction normal to cam surface 26 at the point of contact. This usually oblique contact results in the manifestation of forces perpendicular to the piston axis and tangential to the plane of cam 12 resulting in torsion in the cam wheels and shaft. Because the cam profiles are arranged in substantially equal and opposite positions, the periodic torques that develop are synchronized and additive giving rise to a net torque on the shaft. Because of the symmetry of the cam/piston arrangement these tangential forces produce pure couples about the shaft axis without any rocking moments on the engine structure itself. Variations in the torque magnitude resulting from the intermittent cylinder firing order give rise to a shaft torque variation known as torsional vibration. However, such torsional oscillations that do develop are not of a sufficient magnitude that they can reverse the direction of the net torque experienced in the shaft. This characteristic is helpful in absorbing such vibration in the rotational inertia of the rotary assembly and other techniques known in the art. Such torsional vibration is also minimized by the relatively large number of piston strokes and cycles per revolution produced in this engine configuration.

The lateral force component giving rise to the torque would create a side load on piston rod 22 and thus piston 14 fixed to it, if it were it free to move laterally. However, as pointed out above, the roller followers 28 that straddle cam plate 12 are restrained by the cam contour against such motion thereby preventing such lateral forces from being applied to piston rod 22. As a result, piston 14 is maintained free of side loads that would give rise to friction in its movement within cylinder 16 or 18. Further, roller followers 28 minimize the friction that can occur in contacting cam surfaces 26 as shown in FIG. 5.

As indicated above, the roller follower assembly 20 of the invention is captured by cam plate 12 such that lateral and rotary motion of the piston rod 22 is prevented. It is also shown how the symmetry of the invention results in a perfect balance of longitudinal and lateral shaking forces and rocking moments.

Figure 21:
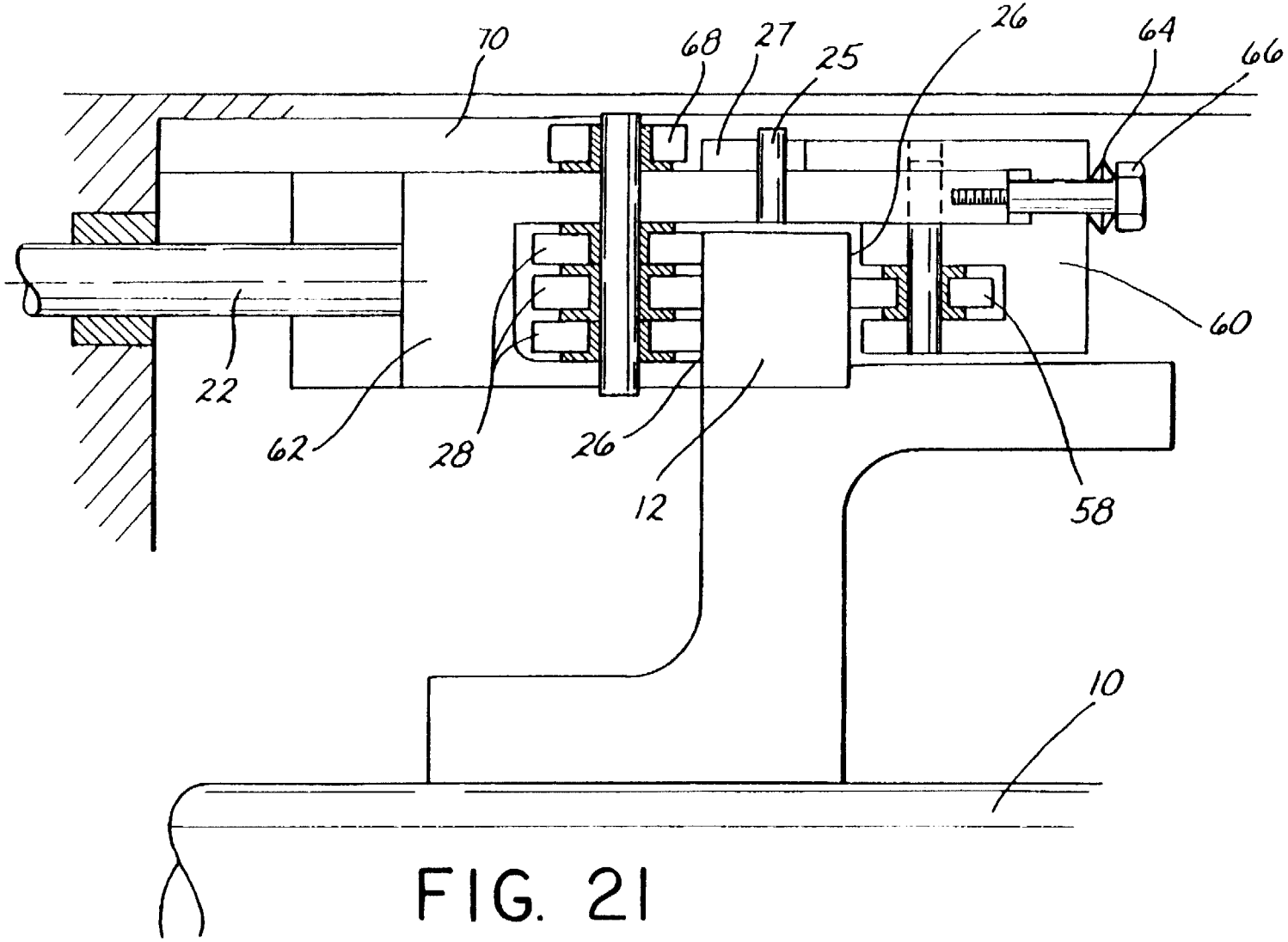
FIG. 21 shows a cam roller follower assembly of one embodiment of the present invention, illustrating its lash and twist elimination features.

Further means of perfecting the internal control of the forces and reactions occurring in and about roller follower 28 owing to its contact with cam 12 are illustrated in FIG. 21. A significant result of two-stroke cycle operation is that rollers 28 on the piston side of cam 12 are always loaded against cam 12 whereas the opposite or slack side roller 58 is loaded only as a consequence of and in reaction to the load imposed on loaded side roller 28. In the presence of lash or clearance between rollers 28 and cam surface 26, some deflection must occur in the follower/piston assembly before slack side roller 58 can engage cam surface 26 and support the follower against the side load produced by the loaded follower 28. Such deflection would bring piston rod 22 into contact with crosshead bearing 30 thereby increasing its load and the friction related thereto. A further consequence of such clearance and any unevenness in the cam profile and rolling resistance of the rollers is that slight torques about the piston rod axis can occur tending to rotate the piston and possibly produce a chattering motion about that axis. As shown in FIG. 21, slack side roller 58 is mounted in a sliding mount 60 that is restrained to move with respect to main fork 62 only along the longitudinal axis, mount 60 being preloaded toward cam 12 by sets of belleville springs 64 captured by shoulder bolts 66 fastened to main fork 62. By such means, slack-side roller 58 is forced into contact with cam surface 26 at all times and under virtually constant force regardless of wear, tolerances or clearances in the parts. An additional feature is also shown in FIG. 21 consisting of guide roller 68 mounted above main fork 62 on the same axis as loaded-side rollers 28. Guide roller 68 is constrained to move only in an axial direction by guide rails 70 fitted into the periphery of the cam housing. By these means, cam follower assembly 20 is constrained to move only in an axially direction with a minimum of lateral or rotary deflections.

An alternative means of maintaining the axial alignment and controlling the angular stability of the cam follower/piston assembly consists of the rectangular piston rod and crosshead shown in FIG. 8. In this embodiment, rotational restraint about the axis of the follower/piston assembly is provided by the fit of the rectangular-section rod 75 in its similarly proportioned crosshead bearings 77 and 79. This structure eliminates the need for the separate guide roller 68 and the guide rail 70 shown in FIG. 21 used with a cylindrical piston rod embodiment.

Figure 22:
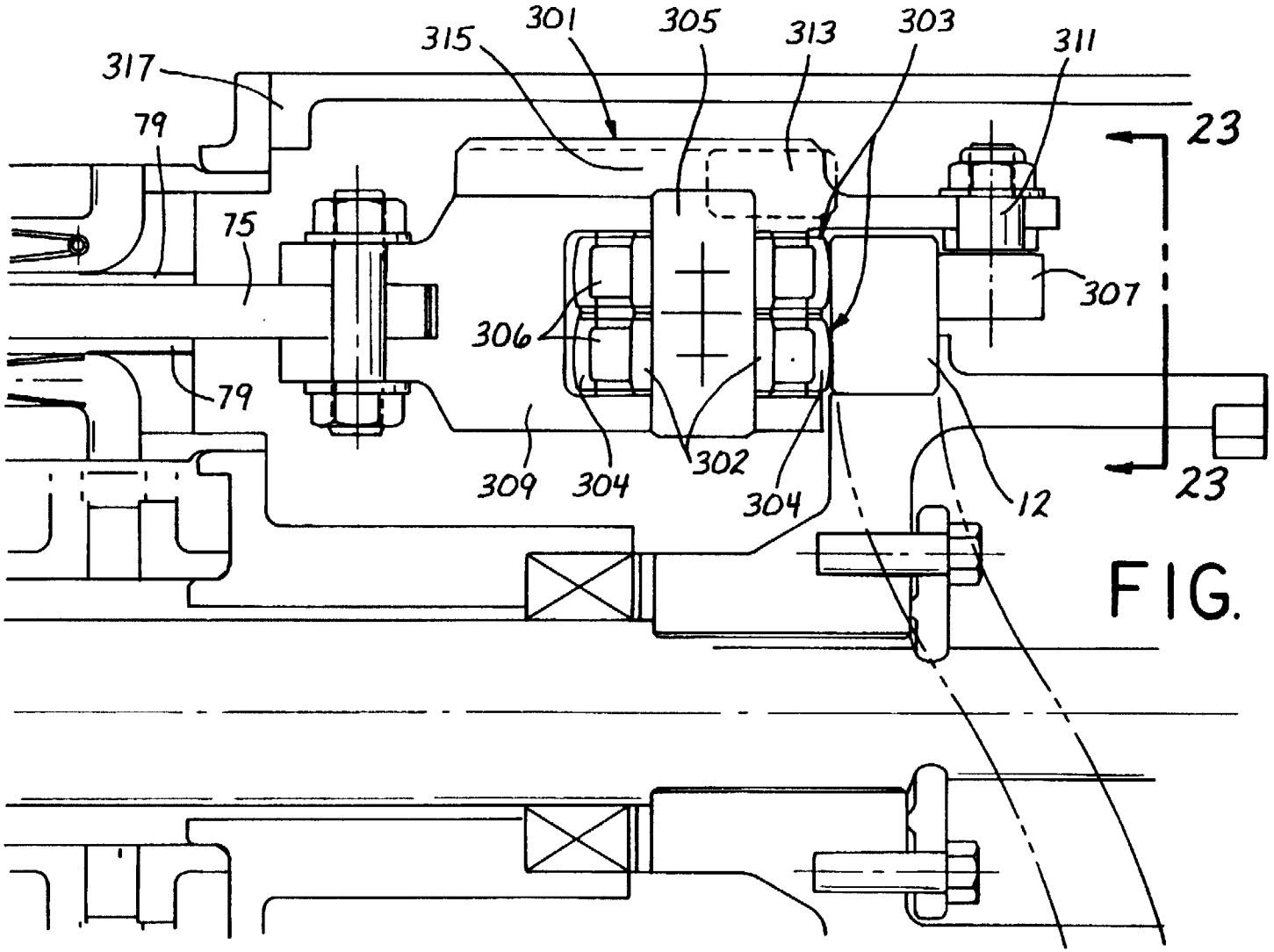
FIG. 22 is a cross-sectional view of an exemplary embodiment of the cam follower assembly of the present invention.
Figure 23:
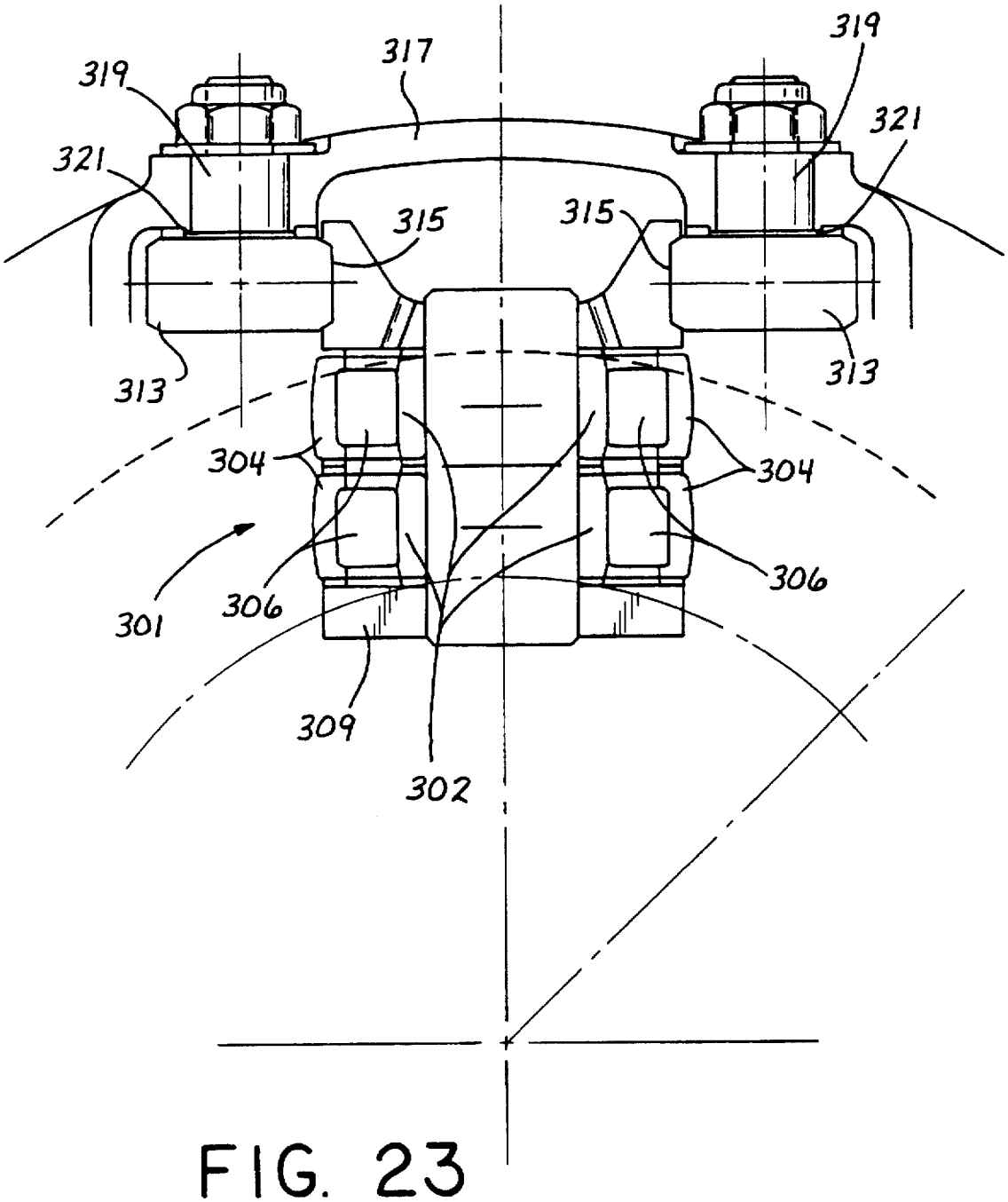
FIG. 23 is an end sectional view of the cam follower assembly of the present invention at section 23—23 as indicated in FIG. 22.
Figure 23A:
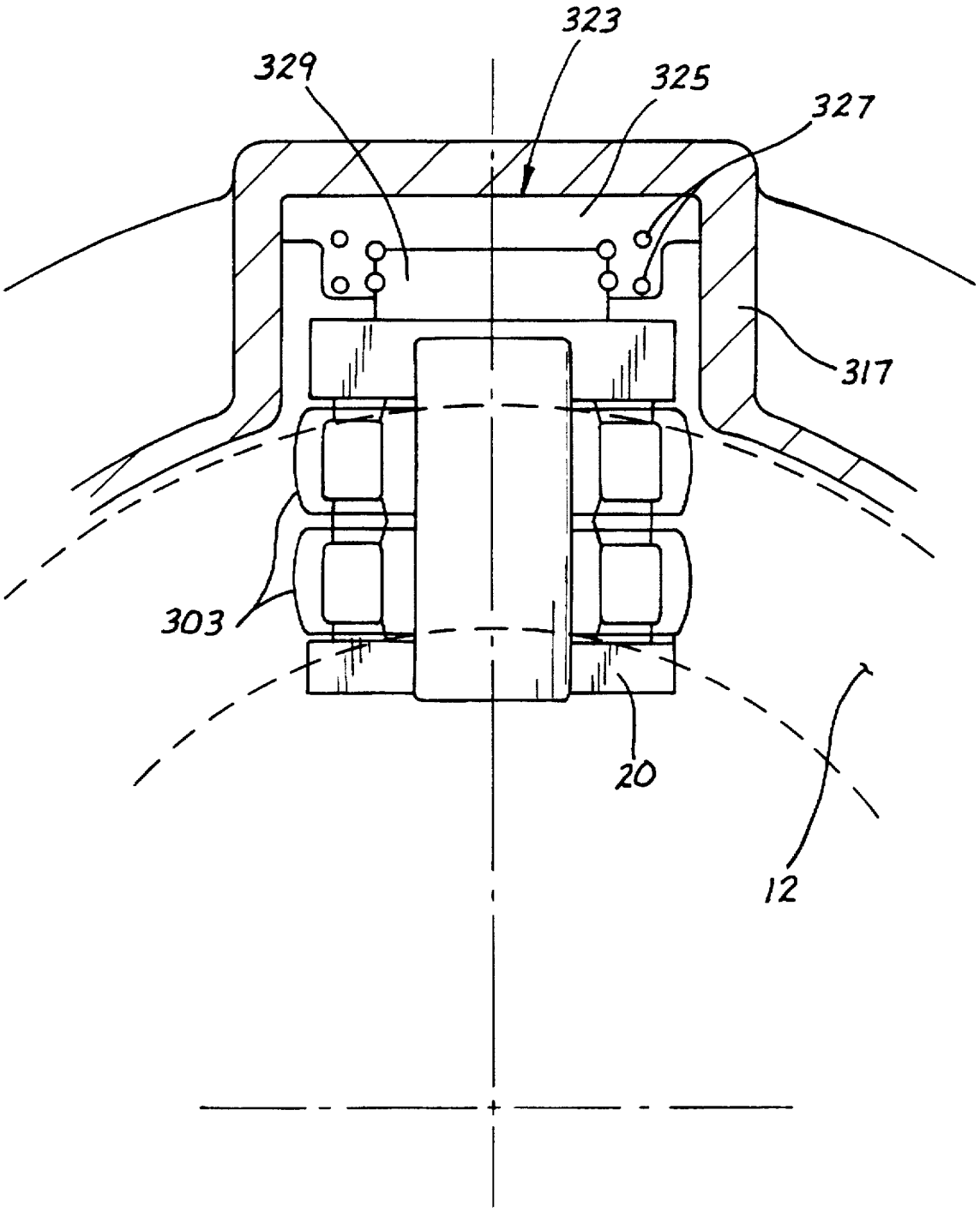
FIG. 23A is an end sectional view of an alternate embodiment of the cam follower assembly of the present invention at section 23—23 as indicated in FIG. 22.

Other alternative means of maintaining the axial alignment of the piston rod and relieving the side loads on crosshead bearing members 77 and 79 are shown in FIGS. 22, 23, and 23A. FIG. 22 is a side sectional view of cam follower assembly 301 attached to the end of rectangular piston rod 75. Cam follower assembly 301 comprises a pair of barrel faced cylindrical roller bearings 303 carried in press pin 305 on the loaded side of cam 12 and an adjustable needle roller guide 307 on the slack side of cam 12. Each of the cylindrical roller bearings 303 has inner bearing races 302 and outer bearing races 304 and a plurality of smaller diameter cylindrical rollers 306 captured within these inner and outer bearing races. Slack side roller guide 307 is mounted to yoke 309 by an eccentric shaft 311 which allows adjustment of its axial position with respect to its loaded side rollers 303 in order to control lash and prevent chattering.

FIG. 23 is an end sectional view of the cam follower assembly 301 showing a pair of cylindrical needle roller guide bearings 313 riding in longitudinal grooves 315 machined in the follower body 309. Needle roller guides 313 support the combined tangential and radial force components generated as reactions to the load of follower 303 against cam 12. Needle roller guides 313 are attached to the engine housing 317 by eccentric shafts 319 and spacers 321 providing adjustment in the alignment of the piston/rod/follower assembly 301 with the cylinder bore axis.

Still other linear bearing arrangements may be used as alternatives to the exemplary embodiments shown in FIGS. 22 and 23 as will be known to those skilled in the mechanical arts. These include the various anti-friction circulating ball guides and crossed-roller bearing units commonly found in precision machine tool applications as well as hydrostatic and hydrodynamic versions of tilting-pad slides.

A preferred embodiment of such a circulating ball linear bearing unit is shown in FIG. 23A. FIG. 23A, like FIG. 23, is an end sectional view of the cam follower assembly taken at section 23—23. FIG. 23A shows the linear guide bearing unit 323 comprising stationary raceway 325, having circulating balls 327, and reciprocating raceway 329. Stationary raceway 325 is fastened to cam housing 317 and reciprocating raceway 329 is fastened to yoke 20.

External anti-friction guide features, such as those depicted in FIGS. 22, 23, and 23A have been found to be valuable for reducing the friction and wear in crosshead elements 77 and 79 and for reducing the operating temperatures and bending stresses in piston rod 75, thereby enabling improvements in structural margins, reduction in reciprocating masses and increases in engine efficiency.

As indicated above, the modular piston/cylinder assemblies 54 are practically free of unbalanced forces that would tend to disturb their location in the engine assembly. This permits a type of engine construction that differs markedly from the prior art in which the cylinders provide the main structural element for containing the reciprocating loads. In the present invention cylinders 16 and 18 are free of such loads, which permits them to be made as identical modular assemblies as illustrated in FIG. 20 and to be attached comparatively lightly to a lightweight center housing member that primarily provides location and radial support for the shaft, its main bearings and the cylinders. Further, this arrangement facilitates the fabrication of such cylinder modules from simple shapes of thermally tolerant materials such as polycrystallne graphite billet and monolithic ceramics, whereby cooling and lubrication can be avoided. The center housing may also be fabricated in lightweight graphite billet material whereby savings in weight, cost and tooling may be obtained.

The details of the fabrication, fastening and joining of the modular cylinders to the center housing have been omitted here because suitable arrangements are many and varied as are known to those skilled in the art. As illustrated in FIG. 20, however, one preferred embodiment consists of clamping cylinder modules 54 between flanges 72 fitted to each end of the center housing (not shown). Flanges 72 are provided with recesses to register and locate the cylinders at each end. Flanges 72 would be sufficiently resilient to clamp each cylinder assembly 54 firmly when a set of tie bolts 74 passing between them and longitudinally beside each cylinder module 54 are tightened.

The engine of the present invention can provide a means of varying its compression ratio by allowing a running adjustment of the clearance volume between pistons 14. In one embodiment, shown in FIG. 24A, a moveable rim 78 for mounting cam ring 12 is fitted to cam wheel 80 to slide back and forth freely in an axial direction. The annular space 82 created by such axial motion is filled with oil which acts as a hydraulic medium under controllable pressure to vary the volume of space 82 displacing rim 78 with respect to wheel 80, thereby changing the relative locations of the opposing pistons 14 as fixed by cams 12. Space 82 is sealed against leakage by O-rings 84 and is ported via drilled passages 86, 88 and 90 to a source of control oil (not shown). Rim 78 is constrained to move axially by the lengths of space 82 and slot 92 by means of detent or key 94 fastened to rim 78 in slot 96 by bolt 98. Rotation of rim 78 with respect to wheel 80 is prevented by detent 94 captured in slots 92 and 96.

FIG. 1 shows how piston clearance is determined by the axial locations and angular phasings of the identical barrel cams and how piston clearance and thus compression ratio will be affected by either relative rotation or axial displacement of the cams. Angular displacement of the cams with respect to each other will also alter the relative timing of pistons in opening and closing the ports. Advancing the relative angular position of the cam controlling exhaust piston in the direction of shaft rotation causes the exhaust port to open before the intake port opens and the intake port to close after the exhaust port closes.

Figure 24B:
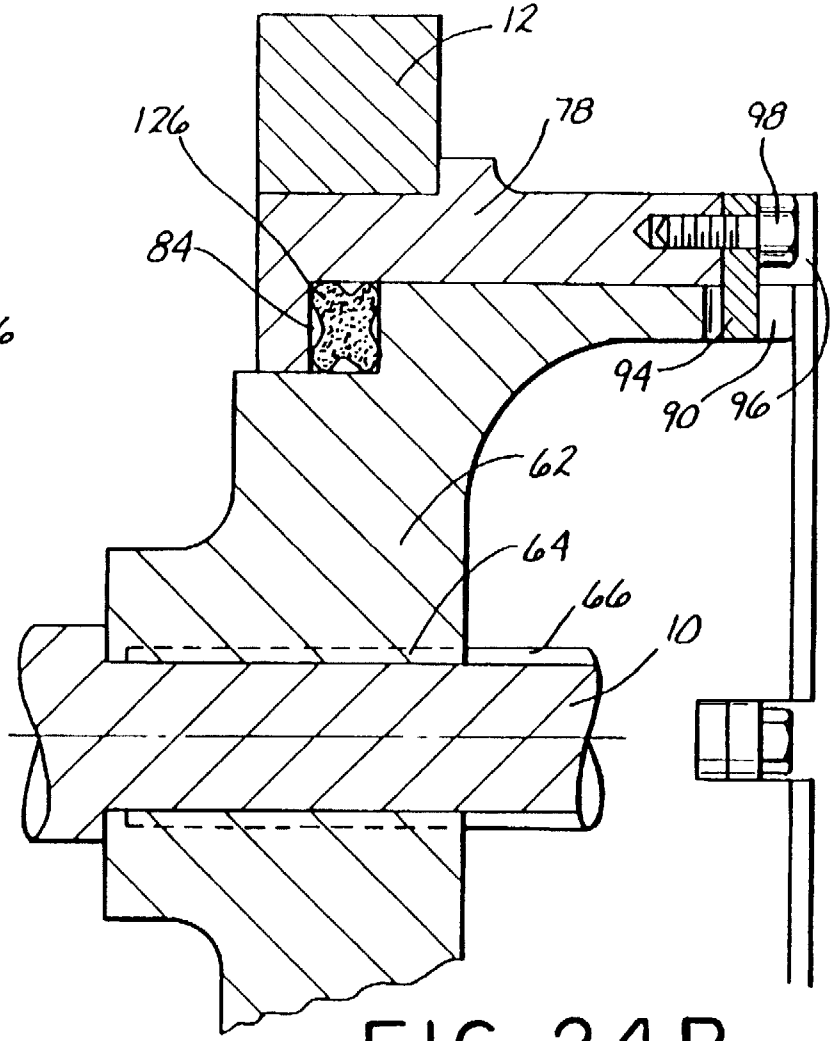
FIG. 24B shows a partially sectioned view of another embodiment of the cam wheel assembly of the present invention, having an elastomerically adjustable cam position.

As discussed above, FIG. 24A shows rectangular key 94 in an axial key slot 92 wherein axial motion of cam wheel 80 produces a change in piston clearance (compression ratio) without a change in piston phasing. An alternative embodiment of the variable compression ratio control of the present invention is shown in FIG. 24B wherein space annular 82 is filled with a viscoelastic medium such as an elastomeric or rubber ring 126. Ring 126 is compressible to a fraction of its relaxed volume such that the pressure of pistons 14 against cam ring 12 automatically changes the volume of space 82 in the direction of increased clearance volume with increased average cylinder pressure. This mode of compression ratio control is appropriate for turbocharged diesel engine applications in which a high compression ratio is desirable for starting, idling and light load operation whereas a reduced compression ratio has advantages in high output operation.

Figure 24A:
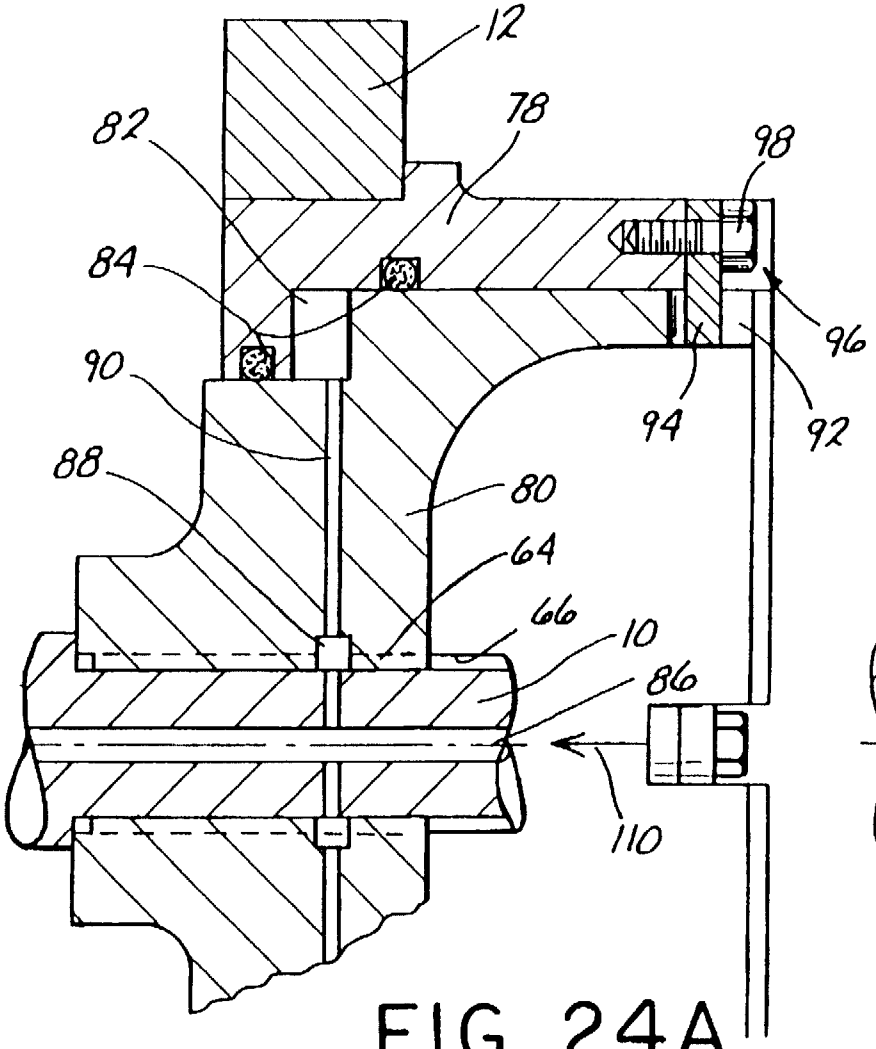
FIG. 24A shows a partially sectioned view of one embodiment of the cam wheel assembly of the present invention, having a hydraulically adjustable cam position.
Figure 24C:
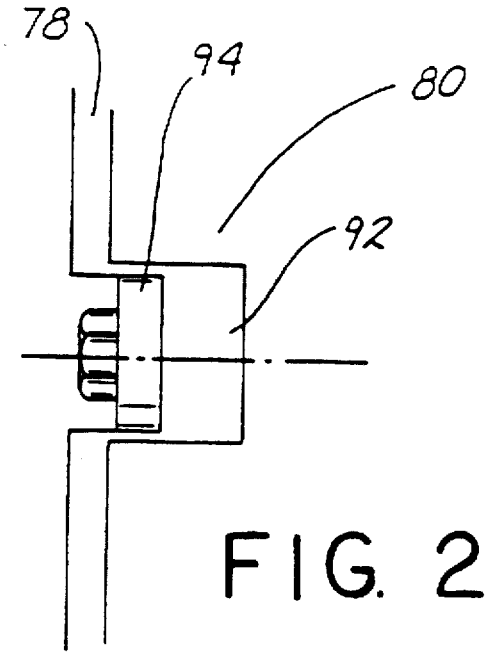
FIG. 24C shows a partial plan view of the rectangle section key in the axial key slot of FIG. 24A looking radially outward from the shaft wherein the key slot is located in the rim of the cam wheel.

A plan view of rectangular key 94 in axial key slot 92 of FIG. 24A is shown in FIG. 24C. However, such motion can be coordinated with an angular displacement of the cam rings wherein piston phasing is altered as well as piston clearance. Additionally, piston phasing can be altered independently of piston clearance.

Figure 24D:
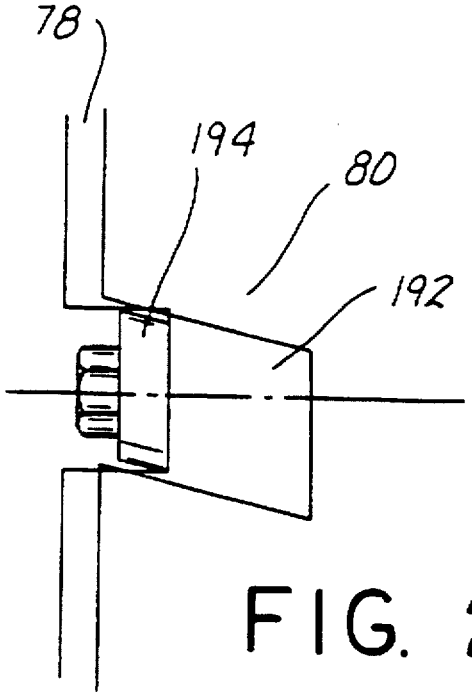
FIG. 24D shows a partial plan view of beveled key in helical key slot located as in FIG. 24A.

One means for coordinated clearance and phase change is shown in FIG. 24D. Here, beveled key 194 is provided which is constrained to move in helical key slot 192. By these means, the axial motion of cam ring 12 generates an angular displacement of that ring. Clearly, the magnitude and direction of the angle of the helix of slot 192 determines the relationship between a change in piston clearance and a change in piston phasing. The angle can be more or less severe and cut in either a right-hand or left-hand direction giving more or less phase change with clearance change and producing either a phase lead or a phase lag as desired.

Figure 25A:
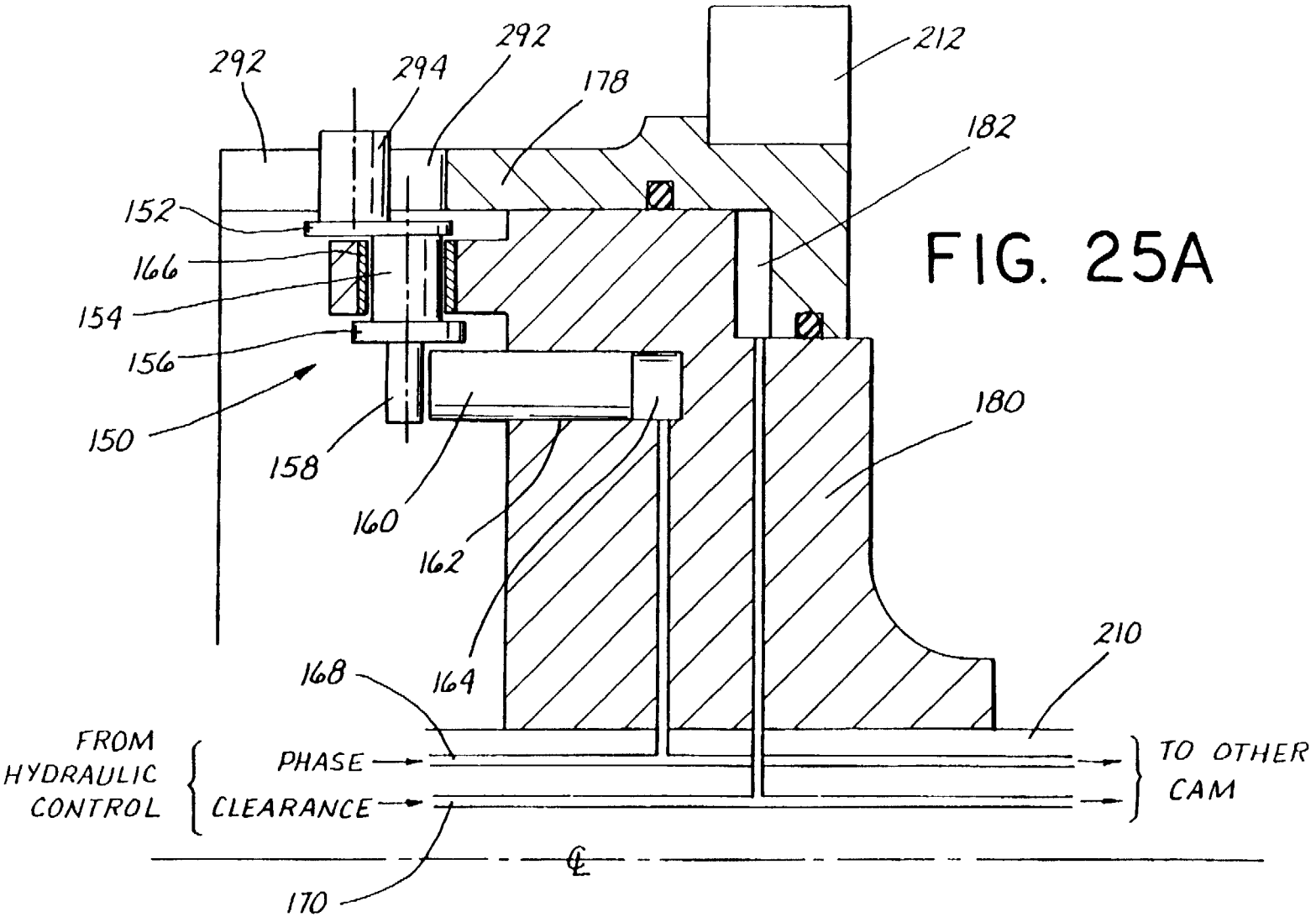
FIG. 25A shows a partial cross-section of an axial key slot located in the outer cam ring rim containing a moveable cylindrical key mounted on an eccentric shaft actuated by a hydraulic cylinder acting through a bell crank.

Another embodiment of the invention is shown in FIG. 25A which shows axial key slot 292 in moveable rim 178 mounting cam ring 212 with key 294 mounted in rim 178 fixed to cam wheel 180. By reversing the locations of key 94 and slot 92 from what was shown in FIG. 24A, key 294 in FIG. 25A can be made to be moveable to effect an angular displacement of cam 212. A mechanism that is readily installed and actuated for this purpose is depicted in FIGS. 25B and 25C showing how angular motion of the cam ring 212 can be obtained independently of axial displacement.

As shown in FIG. 25A, key slot 292 in movable rim 178 mounting cam ring 212 is axial so that when the position of cylindrical key 294 is fixed, motion of rim 178 due to changes in hydraulic pressure changing the volume of annular space 182 occurs in the axial direction only. Motion of cylindrical key 294 in the peripheral direction with respect to wheel 180 causes rotation of movable rim 178 with respect to shaft 210.

FIG. 25A also shows one mechanism for producing tangential (peripheral, angular) motion of cylindrical key 294 under the impetus of hydraulic pressure. The mechanism shown is a crankshaft 150 comprising cylindrical key 294 mounted in outer cheek 152 fixed to shaft 154 to which is fixed inner cheek 156 mounting pin 158. Actuator piston 160 is fitted into axial cylinder 162 forming cylindrical space 164, both formed in an axial bore in cam wheel 180. Piston 160 bears upon inner pin 158 such that hydraulic pressure applied to the cylindrical space 164 causes axially outward motion of piston 160 which rotates shaft 154 via pin 158 and cheek 156 in a small arc. This small arc of travel translates through outer cheek 152 to displace cylindrical key 294 in a direction tangential to rim 178. Since key 194 is captured in axial slot 192 in rim 178, rim 178 is caused to rotate about wheel 180 centered on the shaft centerline. Inner pin 158 and cylindrical key 294 are fixed to shaft 154 on cheeks 152 and 156 respectively that are rotated 90° apart and shaft 154 is guided in bearing 166 which is contained in a radial bore in wheel 180. Thereby, axial motion of pin 158 rotates shaft 154 about its radial axis in wheel 180 which, in turn, produces peripheral motion in cylindrical key 294. Thus, hydraulic pressure applied to cylindrical space 164 via passages 168 produces angular displacement of cam ring 212 with respect to wheel 180 and shaft 210 whereas hydraulic pressure applied to annular space 182 via passages 170 produces independent axial displacement of cam ring 212 with respect to cam wheel 180 which is fixed to shaft 210.

Figure 25B:
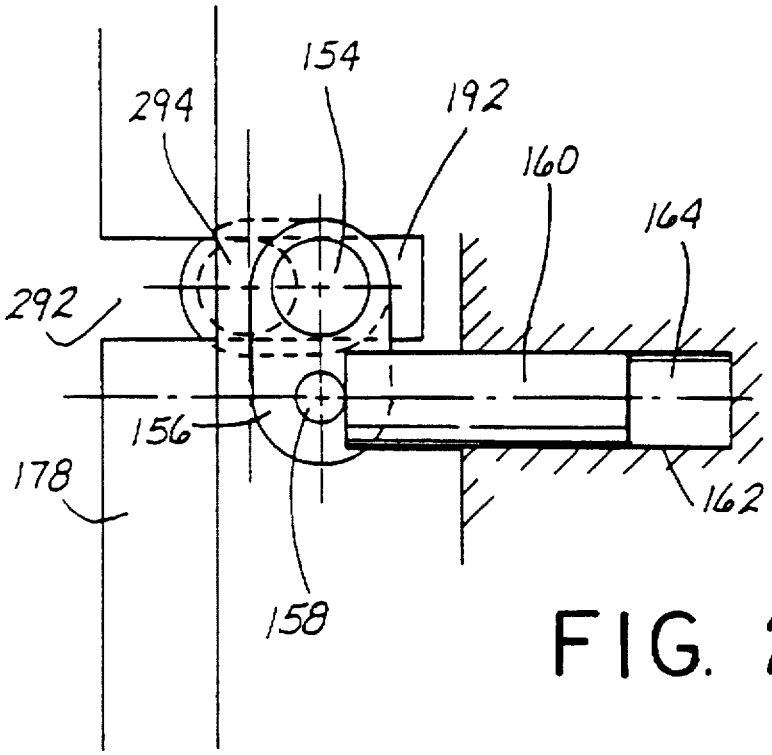
FIG. 25B shows a partial plan view of the mechanism of FIG. 25A.
Figure 25C:
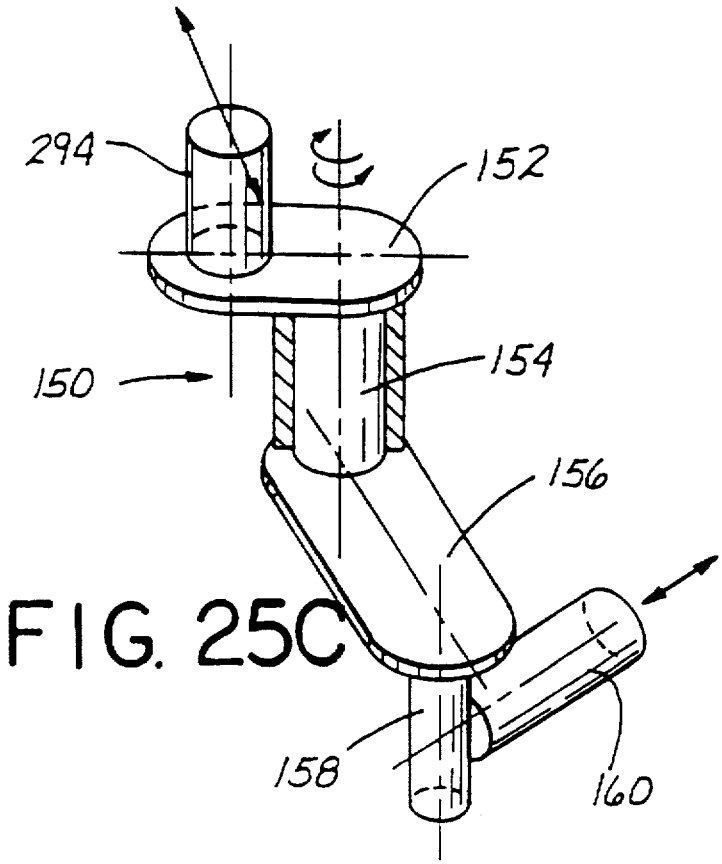
FIG. 25C shows a perspective view of the bell crank mechanism of FIG. 25A.

FIG. 25B shows a plan view of the above mechanism as viewed from the axis of shaft 210 in a radially outward direction. In this view, the 90° offset of cylindrical key 294 from pin 158 as well as the eccentricities of key 294 and pin 158 with respect to shaft 154 are clearly indicated. Thus, the axial motion of piston 160 is translated into peripheral motion of movable rim 178 mounting cam 212, such motion being independent of the axial position of rim 178.

FIG. 25C shows crank mechanism 150 in perspective illustrating the angular and spatial relationships between cylindrical key 294, cheek 152, shaft 154, cheek 156, pin 158 and piston 160, all comprising hydraulically-actuated crank mechanism 150 described above. This geometry allows a rotation of the shaft 154 about its radial axis to produce a tangential motion or rotation of cam ring 212 with respect to the axis of engine shaft 210, thereby changing the cam phasing with respect to the shaft.

The mechanism shown in FIGS. 25B and 25C produces cam 212 angular displacement in one direction by the application of hydraulic pressure on one side of actuator piston 160. A given position is maintained by holding the actuator volume constant. Displacement in the other direction is affected by the outward axial forces applied to cam ring 212 by engine pistons 14 in the same manner as the axial displacement of cam ring 212 is managed. Such forces act in opposition to the hydraulic pressure.

Figure 26:
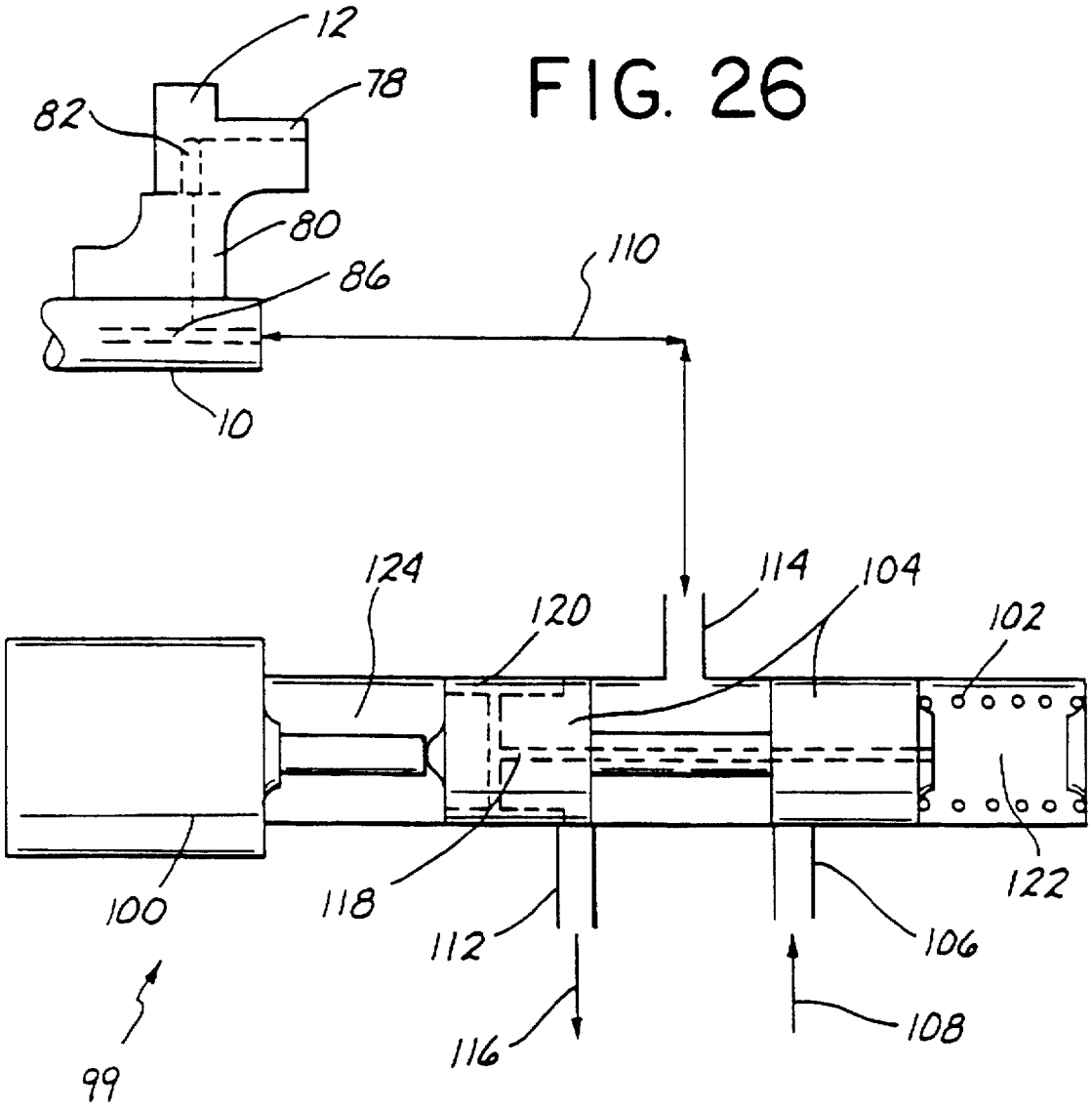
FIG. 26 shows a schematic diagram of a hydraulic control valve for controlling the positions of the cam ring with respect to the cam wheel.

Control of the oil for displacing cam 12 or 212 with respect to shaft 10 is shown in FIG. 26 using three-way spool valve 99 controlled by linear servo 100 acting against spring 102. Servo 100 moves spool 104 uncovering port 106 allowing pressurized oil 108 to enter the shaft supply port 110 and displace cams 12 in the inward direction. To allow cams 12 to move in the outward direction, servo 100 is withdrawn under the impetus of spring 102 closing port 106 and opening port 112. This allows port 114, which connects to shaft supply port 110, to drain into line 116 returning oil to a reservoir (not shown). An equilibrium position of cam 12 is maintained when servo 100 positions spool 104 such that both ports 106 and 112 are closed fixing the volume of oil contained in the passages 110, 86, 80 and space 82 at a constant value. The movement of spool 104 is facilitated by vent passages 118 and 120 connecting spring chamber 122 and servo chamber 124 to line 116 via port 112. This control embodiment is typical of many suitable electrohydraulic control schemes known in the art.

Hydraulic control valve 99 of FIG. 26 is also suitable for controlling both piston clearance and piston phasing. In this embodiment, the electrically-actuated, closed-center, 3-way valve 99 controls the hydraulic fluid volume to cylindrical space 164 and annular space 182 via drilled fluid passages 168 and 170 provided in shaft 210 and cam wheel 180 respectively, as shown in FIG. 25A. Clearly, both engine cams can be controlled together with one set or pair of valves or they may be actuated separately using another pair of valves, i.e. two valves for each cam.

The control of axial piston clearance and phasing has been shown to be arranged by the differential displacement of the axial and angular positions of cam rings 12 or 212 at both ends of the engine. One mode of control is to set and maintain the axial and angular positions of cam rings 12 or 212 at one extreme or the other as called for by engine operating conditions. In this case, valve actuator 100 may be a simple solenoid which, when energized, moves spool 104 against spring 102 to the extreme right-hand position connecting pressure port 108 to the appropriate control passage 110 in shaft 210 and cam wheel 180. Upon release, the solenoid 100 retracts allowing spring 102 to return spool 104 to its extreme left-hand position closing pressure port 108 and connecting the control passage 114 to drain port 116. Thus, the respective cam ring actuator volumes are maintained an one extreme position or the other.

This simple mode of control, using a two-position control valve, would satisfy many engine applications. However, in some engine applications, modulation of the cam axial and angular positions is desirable in which case the control system requires position information and control valve modulation. In a preferred embodiment, the axial position of each of the opposed pistons 14 in one cylinder is continuously monitored with linear variable differential transformers ("LVDT") 300 attached to the slack side of each cam follower 20 (See FIG. 1). The exact position of each piston 14 is thereby determined at every instant.

In addition shaft 10 and cam wheel 80 positions are determined at every instant by the use of a shaft position encoder 400, shown in FIG. 1, or other suitable sensor by which means the exact position and speed of shaft 10 and cam wheels 80 are sensed. The geometry of cams 12 and the engine are known by design. Therefore, the linear and angular position information provided by shaft sensor 400 and piston sensors 300 is sufficient to enable a microprocessor or other control known in the art to ascertain the prevailing piston clearance and phasing. This information is also applied via a suitable feedback control arrangement to operate the electrohydraulic position servo valves 99, shown in FIG. 26, to control the axial and angular cam ring position by controlling the annular space volume 182 and cylindrical space volume 164 of FIG. 25A. The compression ratios and port phasings are thereby established and maintained according to any desired schedule.

Figure 27:
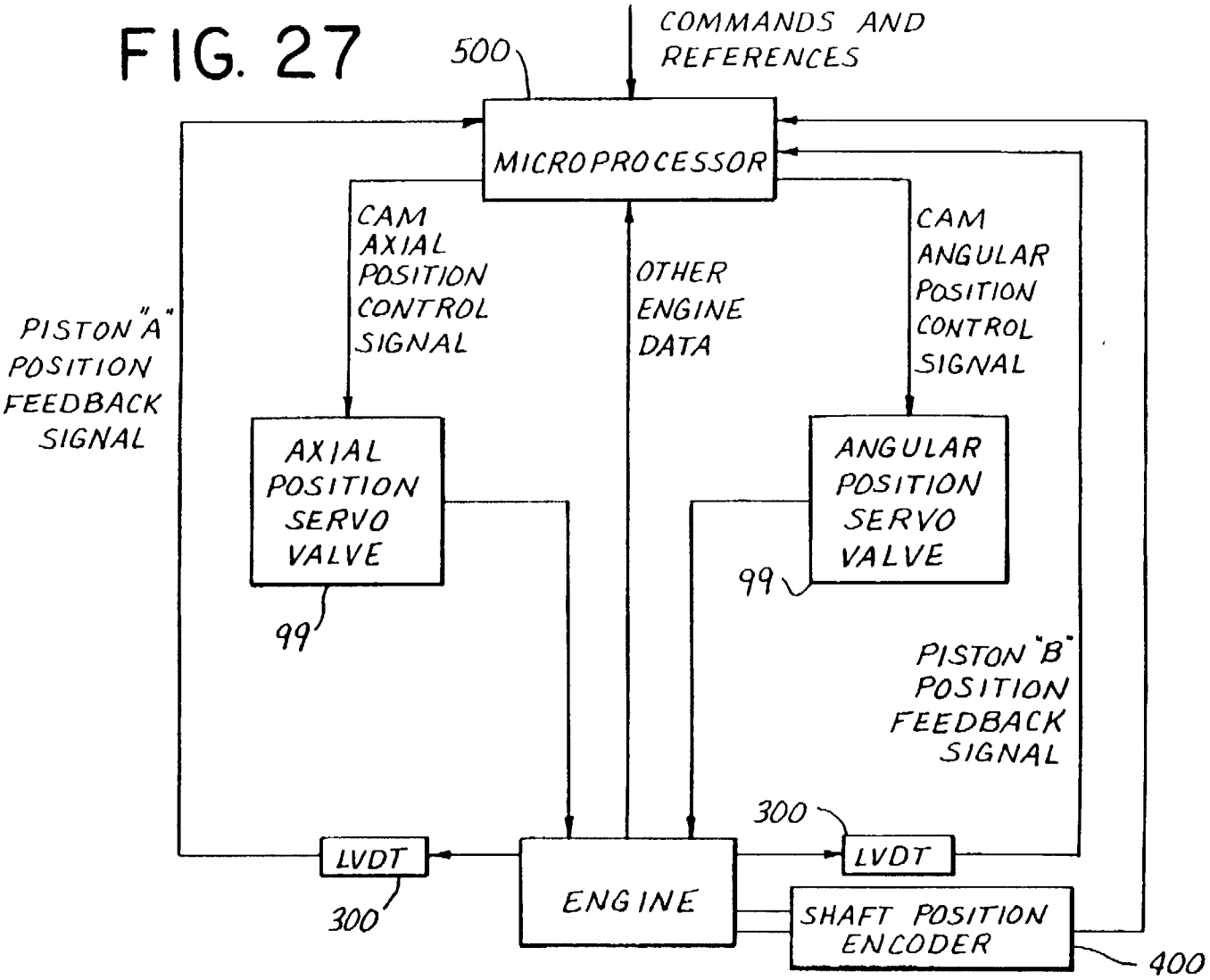
FIG. 27 shows a block diagram of the feedback control system of the present invention wherein the compression ratios and port phasings are independently controlled.

FIG. 27 shows a block diagram of the aforementioned control system arrangement. Microprocessor 500 receives instantaneous feedback information form shaft position encoder 400 and LVDT's 300 on each cam follower assembly 20 to determine shaft angular position and both piston positions at any and all times. Microprocessor 500 then prepares and provides control signals to axial and angular cam position servo controllers (not shown) to satisfy programmed piston phasing and clearance criteria subject to various commands, references, and other engine data as appropriate to the application. Microprocessor 500 combined with the LVDT's 300 and shaft position sensor 400, position servo valves 99 and cylindrical spaces 164 and annular spaces 182 comprise a proportional-plus-integral-plus-differential ("P.I.D.") closed loop control system for piston phasing and compression ratio. Such P.I.D. control systems are well known in the art of automatic controls.

CONCLUSION AND SCOPE OF INVENTION

Thus, it is readily seen that the engine of the present invention provides a highly compact, lightweight, balanced, thermally tolerant and efficient structure and mechanism for producing high torque outputs without supplemental cooling or lubrication.

The axial cylinder, opposed-piston arrangement provides a low frontal area which is a highly valuable characteristic in an aircraft engine. The present invention, though particularly advantageous in aircraft applications, is also applicable to any internal combustion engine application.

The twin, double-harmonic cam arrangement along with the opposed-piston and symmetrical cylinders operating in a two-stroke cycle provides a perfect balance of the forces and moments that would otherwise cause vibration while also providing a maximum utilization of cylinder displacement in the production of shaft torque. This reduced vibration provides noise reduction and reduces structural fatigue, regardless of whether the engine is in an automobile, aircraft, or reciprocating compressor. Furthermore, the enhanced torque output is beneficial in any of the aforementioned applications in that it is capable of simplifying the transmission, increasing power train efficiency, and enhancing the power to weight ratio.

The engine of the present invention may also be utilized wherever thermally tolerant materials would be advantageous. It can be seen by those skilled in the art how the engine structure may be fabricated using various thermally tolerant materials and in various combinations.

Further ramifications of the present invention are that no external aspiration or scavenging accessories are required to implement two-stroke cycle operation and that side loads on all sliding surfaces are prevented as well the scuffing of rolling contact members. Since all the loaded elements are of the rolling contact type, and the virtually unloaded sliding members may be made of thermally tolerant material, such as graphite, the engine of the present invention may be self-lubricated and passively cooled. Thus, any reciprocating heat engine or compressor could utilize the present invention and its concomitant benefits of self-lubrication and self-cooling, thereby simplifying its structure.

Additionally, the control system of the present invention enables automatic control of piston phasing and compression ratios by means of which these engine characteristics can be optimized under various operating requirements.

While the above description of the present invention contains many specific details, these should not be construed as limitations on the scope of the invention, but rather as an exemplification of one preferred embodiment thereof. Many other variations are possible. Accordingly, the reader is requested to determine the scope of the invention by the appended claims and their legal equivalents, and not by the examples which have been given.

What is claimed is:

1. A reciprocating internal combustion engine comprising:

at least one cylinder having at least one piston in said cylinder, said piston comprising a piston rod having a first end and a second end and a piston head rigidly attached to said first end of said piston rod;

a cam housing;

at least one barrel cam mounted within said cam housing on a cam shaft parallel with said cylinder and connected to said second end of said piston rod to impart reciprocating axial motion thereto;

a crosshead at a first cylinder end, said crosshead having a bearing adapted to guide said piston rod;

a cam follower assembly attached to said second end of said piston rod, said cam follower assembly comprising a follower body having guide grooves therewithin and a pair of cylindrical needle roller guide bearings affixed to said cam housing, each of said needle roller guide bearings having an outer race conforming to one of said guide grooves and riding therewithin.

2. The reciprocating internal combustion engine of claim 1 wherein said needle roller guides are attached to said cam housing by eccentric shafts and spacers.

3. The reciprocating internal combustion engine of claim 1 wherein said barrel cam has a first radial surface and a second radial surface and wherein said cam follower assembly comprises a first cam roller comprising a pair of barrel faced cylindrical roller bearings adapted to roll along said first radial cam surface and a second cam roller comprising an adjustable needle roller guide adapted to roll along said second radial cam surface and wherein said cam surfaces are contoured to maintain rolling contact with said first and said second cam rollers at all times.

4. The reciprocating internal combustion engine of claim 3 wherein said cylindrical roller bearings are carried in a press pin on said first radial cam surface and wherein said roller guide is mounted to a yoke by an eccentric shaft.

5. The reciprocating internal combustion engine of claim 1 wherein said cam follower assembly further comprises a first rolling contact cam follower comprising a pair of barrel faced cylindrical roller bearings adapted to roll along said first radial cam surface, each of said cylindrical roller bearings having inner and outer bearing races and further having a plurality of smaller diameter cylindrical roller bearings captured in said inner and outer bearing races, and a second rolling contact cam follower comprising an adjustable needle roller guide adapted to roll along said second radial cam surface.

6. A reciprocating internal combustion engine comprising:

at least one cylinder having at least one piston in said cylinder, said piston comprising a piston rod having a first end and a second end and a piston head rigidly attached to said first end of said piston rod;

a cam housing;

at least one barrel cam mounted within said cam housing on a shaft parallel with said cylinder and connected to said second end of said piston rod to impart reciprocating axial motion thereto, said barrel cam having two radial surfaces;

a crosshead at a first cylinder end, said crosshead having a bearing adapted to guide said piston rod; and a cam follower assembly attached to said second end of said piston rod, said cam follower assembly comprising a first rolling contact cam follower comprising a pair of barrel faced cylindrical roller bearings adapted to roll along said first radial cam surface, each of said roller bearings having inner and outer bearing races and further having a plurality of smaller diameter cylindrical rollers captured in said inner and outer bearing races, and a second rolling contact cam follower comprising an adjustable needle roller guide adapted to roll along said second radial cam surface;

wherein said cam surfaces are contoured to maintain rolling contact with said first and said second cam followers at all times.

7. The reciprocating internal combustion engine of claim 6 wherein said cylindrical roller bearings are carried in a press pin on said first radial cam surface and wherein said roller guide is mounted to a yoke by an eccentric shaft.

8. A reciprocating internal combustion engine comprising:

at least one cylinder having at least one piston in said cylinder, said piston comprising a piston rod having a first end and a second end and a piston head rigidly attached to said first end of said piston rod;

a cam housing;

at least one barrel cam mounted within said cam housing on a cam shaft parallel with said cylinder and connected to said second end of said piston rod to impart reciprocating axial motion thereto;

a crosshead at a first cylinder end, said crosshead having a bearing adapted to guide said piston rod;

a cam follower assembly attached to said second end of said piston rod, said cam follower assembly comprising a circulating ball linear guide bearing unit comprising an inside reciprocating raceway affixed to said cam follower assembly and enclosed by an outer stationary raceway attached to said cam housing.

9. A reciprocating internal combustion engine comprising:

at least one cylinder having at least one piston in said cylinder, said piston comprising a piston rod having a first end and a second end and a piston head rigidly attached to said first end of said piston rod;

a cam housing;

at least one barrel cam mounted within said cam housing on a cam shaft parallel with said cylinder and connected to said second end of said piston rod to impart reciprocating axial motion thereto;

a crosshead at a first cylinder end, said crosshead having a bearing adapted to guide said piston rod;

a cam follower assembly attached to said second end of said piston rod, said cam follower assembly comprising a follower body having guide grooves therewithin and a pair of cylindrical needle roller guide bearings affixed to said cam housing by eccentric shafts and spacers, each of said needle roller guide bearings having an outer race conforming to one of said guide grooves and riding therewithin.

* * * * *